United States Patent [19]

Baker et al.

[11] 4,273,190

[45] Jun. 16, 1981

[54] METHOD AND APPARATUS FOR GRAVEL PACKING MULTIPLE ZONES

[75] Inventors: Eugene E. Baker; David D. Szarka, both of Duncan, Okla.; Odie R. S. Davis, Humble; Nolan M. Workman, Lewisville, both of Tex.

[73] Assignee: Halliburton Company, Duncan, Okla.

[21] Appl. No.: 107,699

[22] Filed: Dec. 27, 1979

[51] Int. Cl.[3] ..... E21B 43/04

[52] U.S. Cl. ..... 166/278; 166/51; 166/334

[58] Field of Search ..... 166/51, 278, 315, 332, 166/334, 184, 185

[56] References Cited

U.S. PATENT DOCUMENTS

| | | | |
|---|---|---|---|
| 3,153,451 | 10/1964 | Chancellor et al. | 166/51 |
| 3,637,010 | 1/1972 | Maly et al. | 166/51 |
| 3,710,862 | 1/1973 | Young et al. | 166/278 |
| 3,726,343 | 4/1973 | Davis, Jr. | 166/278 |
| 3,901,318 | 8/1975 | Fortenberry | 166/278 |
| 3,913,676 | 10/1975 | Barbee, Jr. et al. | 166/278 |
| 3,926,409 | 12/1975 | Abney et al. | 251/344 |
| 3,952,804 | 4/1976 | Smyrl | 166/278 |
| 3,987,854 | 10/1976 | Callihan et al. | 166/278 |
| 4,019,592 | 4/1977 | Fox | 175/234 |
| 4,044,832 | 8/1977 | Richard | 166/278 |
| 4,049,055 | 9/1977 | Brown | 166/278 |
| 4,105,069 | 8/1978 | Baker | 166/51 |
| 4,192,375 | 3/1980 | Maly et al. | 166/51 |

*Primary Examiner*—Stephen J. Novosad

*Attorney, Agent, or Firm*—Joseph A. Walkowski; John H. Tregoning

[57] ABSTRACT

A method of gravel packing multiple zones with a single trip of the operating string into a well without inducing fluid movement across zones, and without disturbing the zone being packed in reverse circulation. Apparatus is disclosed to perform the method, comprising a screen liner assembly surrounding a concentric operating string. Mechanical force on the operating string is used to change all tool modes of the apparatus. The operating string is accurately positioned with respect to the screen liner assembly at every zone level and zones may be easily relocated if necessary. Zones may be packed in any order, and a zone may be repacked, if necessary, during the same trip into the well.

37 Claims, 25 Drawing Figures

METHOD AND APPARATUS FOR GRAVEL PACKING MULTIPLE ZONES

SUMMARY OF THE INVENTION

Unconsolidated formations, particularly those containing loose sands and soft sandstone strata, present constant problems in well production due to migration of loose sands and degraded sandstone into the well bore as the formation deteriorates under the pressure and flow of fluids therethrough. This migration of particles may eventually clog the flow passages in the production system of the well, and can seriously erode the equipment. In some instances, the clogging of the production system may lead to a complete cessation of flow, or "killing" of the well.

One method of controlling sand migration into a well bore consists of placing a pack of gravel on the exterior of a perforated or slotted liner or screen which is positioned across an unconsolidated formation to present a barrier to the migrating sand from that formation while still permitting fluid flow. The gravel is carried to the formation in the form of a slurry, the carrier fluid being removed and returned to the surface. The proper size of gravel must be employed to effectively halt sand migration through the pack, the apertures of the liner or screen being gauged so that the gravel will settle out on its exterior, with the slurry fluid carrying the gravel entering the liner or screen from its exterior.

Prior to effecting the gravel pack, drilling mud and other contaminants may be washed from the well bore, and the formation treated. Commonly employed treatments include acidizing to dissolve formation clays, and injecting stabilizing gels to prevent migration of formation components and formation breakdown prior to packing.

"Reverse circulation" is a widely employed procedure by which wells are gravel packed. Currently, a liner assembly having a perforated liner or screen is positioned across the unconsolidated formation, commonly referred to as the "zone" to be packed. If the well is to be unlined, the screen is incorporated in the well casing. For purposes of illustration it is assumed that one is packing a lined well. Subsequently, a packer is set above the zone between the liner and the well casing. A tubing string is run inside the liner assembly at the area of the zone, there being created between the liner and tubing string an annulus. Gravel slurry is pumped down this annulus, out into the annulus between the liner and the casing below the packer at a suitable location above the zone where it descends and the gravel is deposited in the area of the screen as the carrier fluid passes through the screen in the liner assembly, being removed from the zone area through the tubing string. A crossover device incorporated in the packing apparatus at the level of the zone being packed routes the upward moving returning fluid back outside the liner assembly, the fluid then traveling up to the surface. A pressure buildup is noted at the surface as the gravel level reaches the top of the screen, indicating that a successful pack has been achieved. Thereafter, the flow of gravel-laden fluid is stopped. If desired the crossover tool may then be closed and pressure applied in the same direction as the slurry flow to squeeze the slurry into the formation, thus consolidating the gravel pack. After squeezing, the crossover tool is opened again, and the circulation of fluid is reversed, a clean fluid being pumped down the inner tubing and back up the annulus between it and the liner assembly in order to flush out this area. Subsequently, the well may be subjected to other treatments if necessary, and produced.

Several different approaches have been taken to effect this reverse circulation method of packing, some of them possessing features which permit the packing of a well with more than one zone.

U.S. Pat. No. 3,710,862, entitled "Method and Apparatus for Treating and Preparing Wells for Production," by Carter R. Young and Henry J. James, assigned to Otis Engineering Corporation, discloses a method and apparatus whereby multiple zones may be packed utilizing a reciprocation-operated crossover tool with an inner operating string for return of fluid to the surface. However, only one zone may be gravel packed per trip in the well, the zones must be isolated and packed from the bottom zone upward, and there is no possibility of revisiting or repacking a zone once the initial trip has been completed. Furthermore, a separate production string must be run back down into the well to seal off the gravel ports in the liner before producing the well, or a similar production seal connnecting member attached to the bottom of the next higher screen assembly must be employed if another, higher zone is to subsequently be packed. Aside from requiring multiple trips for the production string as well as the operating string, the top of the screen assembly in the well and the gravel ports in the liner remain open while the operating string is retrieved and a seal is run down the well.

U.S. Pat. No. 3,952,804, entitled "Sand Control for Treating Wells With Ultra High Pressure Zones," issued to Kenneth E. Smyrl and assigned to Dresser Industries, Inc. discloses a method and apparatus for gravel packing multiple zones, but again involves the use of multiple trips into the well, and is further complicated by the necessity of employing a killing fluid to contain the pressure in the well between zone packs.

The prior art also includes a concentric string gravel packing method and apparatus, disclosed in U.S. Pat. No. 4,044,832, entitled "Concentric Gravel Pack With Crossover Tool and Method of Gravel Packing" issued to Charles A. Richard and Philip Barbee, and assigned to Baker International Corporation. This method and apparatus are only suitable for a single zone pack, however, and results in gravel ports above the pack being left open after the packing operation, with the attendant possibility of flow and sand migration bypassing the gravel pack.

Other methods and apparatus for gravel packing have also been employed in the prior art, as disclosed in U.S. Pat. Nos. 3,637,010, 3,726,343, 3,901,318, 3,913,676, 3,926,409, 3,963,076, 3,987,854, 4,019,592, and 4,049,055. However, all of them are unsuitable for use in packing multiple zones, and possess one or more additional deficiencies with respect to mode of operation and results achieved, as will be enumerated hereafter.

An improved apparatus giving the capability of multiple zone gravel packing in a single trip in the well is disclosed in U.S. Pat. No. 4,105,069, entitled "Gravel Pack Liner Assembly and Selective Opening Sleeve Assembly For Use Therewith" issued to Eugene E. Baker and assigned to Halliburton Company. However, the disclosed apparatus does not possess the capability of packing without disturbing other zones or of reverse circulating without fluid flow across the zone just packed. In addition, the location of the tool string at the zone being packed depends on the balancing of weight to ensure that the gravel packer rests in place on the sleeve of the gravel collar, but does not move the sleeve downward and close the ports in the gravel collar, a delicate operation in deep and highly deviated wells.

Generally, the prior art suffers from a number of deficiencies which prohibit efficient multiple zone gravel packing. From among these is the inability to pack multiple zones with only one trip of the operating string into the well. With the exception noted above, the prior art builds the outer string containing the packing screens from the bottom up in a step-by-step process, and thus the operator must withdraw the operating string between zones in order to add components to the outer string. This also renders it impossible to pack an upper zone before a lower zone, or to set or inflate packers in any order than lowest, first. Because of the order in which the zones are packed, it is also impossible to repack zones below the uppermost. In some instances this is due to inability to place the operating string back in the desired location, due to restrictions placed in the outer string after packing a zone. In other cases, it is due to an inability to relocate the desired zone and the position of the gravel ports with any precision. Additionally, many prior art devices utilize hydraulic operation, which is susceptible to faulty operation or failure. Furthermore, in other prior art devices, connection and disconnection of tools utilizes slots and pins and shear pins, the former of which requires axial and radial alignment, difficult in highly deviated wells, and the latter permits no reconnection or return to a previous tool mode. Finally, there is no procedure in the prior art to assure packing without contamination of adjacent zones, either higher or lower than the zone in question, or to reverse circulate without disturbing the zone being packed.

In contrast, the present invention overcomes all of the previously enumerated disadvantages and limitations of the prior art by providing a new and advantageous method and apparatus for gravel packing multiple zones in a well in any sequence with positive zone isolation from the beginning of the packing operation. The present invention contemplates a concentric two-string tool system. The outer string, preferably referred to as the screen liner assembly, which is hung in the production casing if such is employed, comprises a number of different components. From the bottom of the well, or, if not at bottom, from a bridge plug used to isolate the well bore below the lowermost zone and position the screen liner assembly, there is located a guide shoe, a gravel screen, a concentric string anchor tool, a polished nipple of predetermined length to assure proper positioning of tools in the operating string, a three position full open gravel collar and a suitable casing inflation packer, such as the Lynes External Casing Packer, shown on pages 1 and 2 of the Lynes 1978–79 Catalog for Formation Testing, Inflatable Packer, Inflatable Specialty Tools, and Bottom Hole Pressure and Temperature Sensing Treatments. The screen is, of course, located across the zone of interest, and the gravel collar placed above the zone. The casing inflation packer provides isolation of the zone from those above it. This sequence of tools, augmented with blank pipe between zones to assure proper position of the gravel screens across zones, is repeated up the well bore until all zones of interest have been traversed. At the top of the screen liner assembly is placed a suitable liner hanger tool, such as the Otis Engineering Corporation Type GP Packer, shown on page 70 of the OEC 5120A Catalog, entitled "Otis Packers, Production Packers and Accessories," whereby the screen liner assembly is hung at a predesignated point in the production casing. It is also possible to use the gravel screens, anchor tools, full open gravel collars and casing inflation packers as part of a full string of production casing in lieu of employing a liner.

Employed within the screen liner assembly is an operating string also comprising a plurality of components. Lowermost in this string is a tail pipe, followed by a closing sleeve positioner, a selective release anchor positioner, an opening sleeve positioner and a ball check valve. Above the check valve is run an isolation gravel packer, above which are provided two concentric strings of tubing of suitable length to assure that a crossover tool which may be placed at the top of the operating string will be located above the liner hanger an adequate distance to allow reciprocation of the string while permitting the anchor positioner to engage the lowermost anchor tool in the screen liner assembly. To permit the coupling of the concentric tubing strings into the crossover tool, a tubing swivel and slip joint are provided on the inner tubing immediately below the crossover tool to compensate for variations in length of the two tubing strings.

The operating string is run into the hole inside the screen liner assembly, and the casing inflation packers inflated either on the trip down, or, at the operator's discretion, as the packing proceeds from the lowermost zone of interest through the higher zones. This is not to imply that zones must be packed in this order, or in any order whatsoever, as it is possible to pack the lowest zone first, then the highest zone, then an intermediate zone if so desired. Likewise, the casing inflation packers may be inflated in any order. For the purposes of illustration, however, it is assumed that each packer is inflated as the operating string descends into the well. The operating string is anchored by engagement of the anchor positioner with the anchor tool at that zone, and the packer inflated at each location, the anchor positioner being then released and the operating string lowered to the next zone. After all the packers are inflated and the operating string is at the lowest zone of interest in the well, the full open gravel collar is opened by the opening sleeve positioner, the operating string is anchored in place and gravel packing is begun. Gravel packing and reverse circulation are effected without further manipulation of the operating string or screen liner assembly. After packing is completed, the anchor positioner is released and the operating string raised to the next zone of interest, the closing sleeve positioner closing the gravel collar as it passes. At the location of the next zone of interest, the full open gravel collar at the higher zone is opened and the anchor positioner of the operating string is then engaged in the anchor tool at that zone. From this point, packing proceeds as previously described. If necessary, a previously packed zone may be revisited simply by releasing the anchor positioner and raising or lowering the operating string to the desired location and engaging the anchor tool at that zone. It is thus apparent that all zones in a well may be packed during one trip of the operating string, which is then removed from the well for production. It is also obvious that the disclosed method and apparatus for gravel packing may also be utilized for other types of well treatment, such as acidizing.

BRIEF DESCRIPTION OF THE DRAWINGS

FIGS. 1A, 1B, 1C and 1D provide a simplified vertical cross-sectional elevation illustrating the operating string and screen liner assembly of the present invention, with components for gravel packing two producing formations in a well.

DESCRIPTION OF THE PREFERRED EMBODIMENT

Figure 1A:
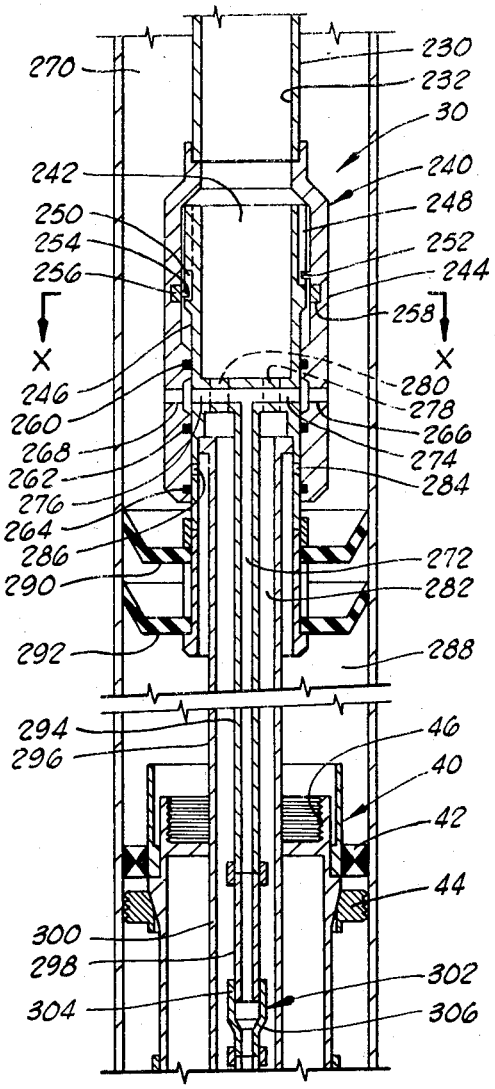

Referring now to the drawings, and to FIGS. 1A through 1D in particular, the screen inner assembly and operating string of the present invention are illustrated in simplified form for the sake of clarity. The operating string is generally designated by the reference character 30, while the screen liner assembly concentrically surrounding it is designated by the reference character 32. Disposed about the two concentric strings of the present invention is well casing 34, having perforations therethrough at the levels of two unconsolidated producing formations 26 and 28, through which the well bore passes. Should the method and apparatus of the present invention be employed in a well that does not employ a liner, the components referred to as incorporated in the screen liner assembly 32 may be incorporated in the well casing 34, utilizing a suitably sized operating string within.

Screen liner assembly 32 is secured within well casing 34 by means of a suitable liner hanger 40 with casing packer 42, as illustrated schematically. Liner hanger 40 is positioned in casing 34 by means of slips 44 employed in mechanically setting packer 42. Threaded collar 46 is employed to secure screen liner assembly 32 to a drill string during its installation in the well bore inside the well casing 34.

Moving downwardly from liner hanger assembly 40, the screen liner assembly comprises a length of blank pipe (not shown) to a location just above the highest zone to be packed. At that point is located a casing inflation packer, illustrated schematically at 50. Annular space 52 defined by mandrel 54 and elastomeric outer wall 56 is inflated by pumping fluid through schematically illustrated check valve 58 to a predetermined pressure.

Below packer 50 is located full open gravel collar 60 comprising outer body 62 within which is longitudinally slidably disposed sleeve 64. At the top of body 62 is located necked-down portion 66, bounded by beveled edges. Below necked-down portion 66 is shoulder 68, followed by inner cylindrical surface 70, through which gravel ports 72 and 74 extend (more than two may be employed, if desired). Below inner surface 70 is annular shoulder 76, followed by annular groove 78, cylindrical surface 80 of substantially the same inner diameter as shoulder 76, and annular groove 82. The inner diameter of the lowest extremity 84 of gravel collar 60 is substantially the same as that of polished nipple 106, located immediately below it. Inside body 62 sleeve 64 has disposed thereabout annular seals 86, 88, 90 and 92. At the top of sleeve 64 is located inwardly beveled annular surface 94, below which is downward facing annular shoulder 96. Between annular seals 88 and 90 apertures 98 and 100 communicate with gravel ports 74 and 72 when aligned therewith by longitudinal movement of sleeve 64. At the lowest extremity of sleeve 64 are located a ring of collet fingers 102 having radially outward extending lower ends.

Anchor tool 110 is located below polished nipple 106. At the top of anchor tool 110 an outwardly beveled surface leads to annular recess 112, below which is upward-facing annular shoulder 114, below which an outwardly beveled surface leads to annular recess 116, followed by an inwardly beveled surface leading to cylindrical surface 118, which is of substantially the same inner diameter as blank pipe 120, immediately below.

Gravel screen 122 is disposed across the upper producing formation or zone of interest below blank pipe 120.

Referring to the lower zone of interest, casing inflation packer 130, substantially identical to packer 50, is located below gravel screen 122 to isolate the upper zone of interest from the lower zone. Space 132 defined by mandrel 134 and elastomeric outer wall 136 is inflated by pumping fluid through schematically illustrated check valve 138 to a predetermined pressure.

Below packer 130 is located a second full open gravel collar 140, substantially identical to gravel collar 60. Gravel collar 140 comprises outer body 142 within which is slidably disposed sleeve 144. At the top of body 142 is located necked-down portion 146, bounded by beveled edges. Below necked-down portion 146 is shoulder 148, followed by inner cylindrical surface 150, through which gravel ports 152 and 154 extend. Below inner surface 150 is shoulder 156, followed by annular groove 158, cylindrical surface 160 of substantially the same inner diameter as shoulder 156, and annular groove 162. Below groove 162 an inwardly beveled surface leads to the lowest extremity of gravel collar 140, the inner diameter of which is substantially the same as that of polished nipple 182, immediately below it in the screen liner assembly 32. Sleeve 144 possesses annular seals 164, 166, 168 and 170. At the top of sleeve 144 lies inwardly beveled surface 172, below which is downward facing shoulder 174. Between annular seals 166 and 168, apertures 176 and 178 communicate with gravel ports 152 and 154 when aligned therewith. At the lowest extremity of sleeve 144 are located a ring of collet fingers 180 having radially outward extending lower ends.

Second anchor tool 190 is located below polished nipple 182. At the top of anchor tool 190 an outwardly beveled surface leads to annular recess 192, below which is upward-facing annular shoulder 194, below which an outwardly beveled surface leads to annular recess 196 followed by an inwardly beveled surface leading to cylindrical surface 198, which is of substantially the same inner diameter as blank pipe 200.

Gravel screen 202 is disposed across the lower producing formation or zone of interest. Gravel screens 122 and 202 are fore-shortened in the drawings herein, and actually may be a number of feet in length, the length being determined by the thickness of the producing formation to be gravel packed, all of which is evident to those skilled in the art, it being further evident that the gravel screens may have perforations, as shown, or may employ wire-wrapped slots to form the desired operations.

Another length of blank pipe 204 is attached below gravel screen 202, and the lowest end of the pipe is capped with a float shoe 206.

It should be noted that the proper orientation of operating string 30 with respect to screen liner assembly 32 is dependent upon the polished nipples 106 and 182 being of the appropriate length to position isolation gravel packer and bypass assembly 320 (see FIG. 1C) across either gravel collar 60 or 140 when the operating string 30 is anchored in place at the zone being packed.

The screen liner assembly 32 having been described in detail, the operating string 30 will now be described from the top thereof downward, referring to FIGS. 1A through 1D, 2, 4, 5A, 5B, 6A, 6B, and 7 through 10.

Figure 5A:
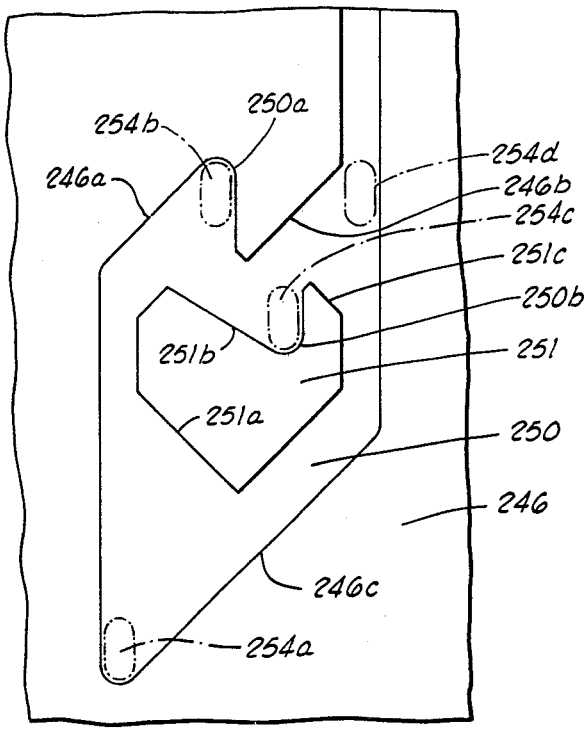
FIGS. 5A and 5B are developments of the slots of the crossover tool.
Figure 5B:
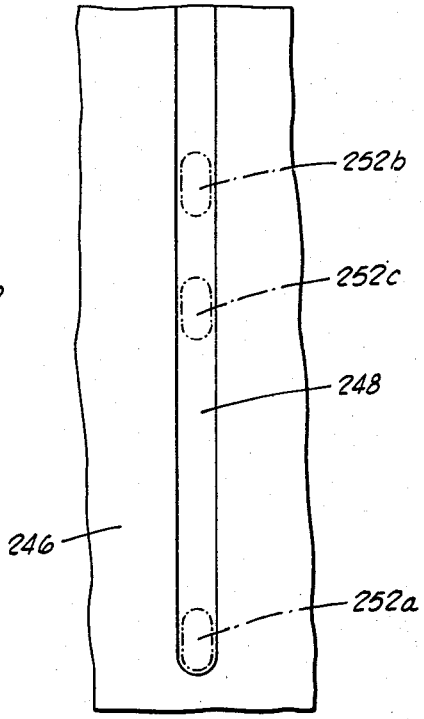
Figure 7:
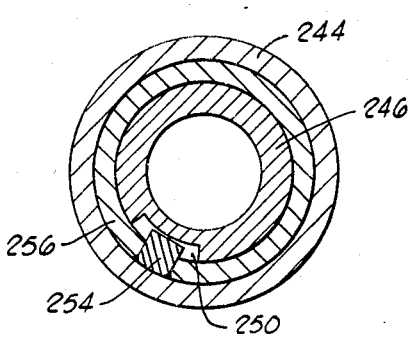
FIG. 7 is a horizontal cross-sectional elevation of the crossover tool taken on line x—x of FIG. 1A.
Figure 8:
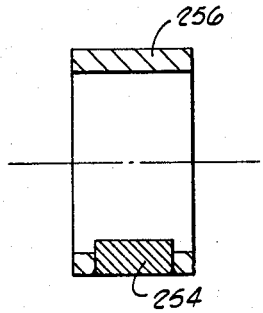
FIG. 8 is a cross-sectional view of the pin and ring assembly of the crossover tool.

Reference character 230 depicts the lower extremity of a pipe by which the operating string 30 is lowered into the well inside liner assembly 32. Pipe 230 has bore 232 which communicates with bore 242 in the upper part of crossover tool 240. Crossover tool 240 comprises outer sleeve 244 and inner case 246. Outer sleeve 244 is fixed to pipe 230 and slidably disposed about inner case 246, the opening and closing of the crossover tool being effected by reciprocation of outer sleeve 244 through the movement of pipe 230 on the surface. Inner case 246 has two slots, 248 and 250, in its outer surface. Developments of these slots are illustrated in FIGS. 5A and 5B. These slots slidably engage pins 252 and 254, respectively, which are connected to the outer sleeve 244. Pin 252 is fixed to outer sleeve 244 and slides vertically in straight slot 248, a development of which is shown in FIG. 5B. Pin 254 is fixed to ring 256, which is rotationally slidably housed in annular recess 258 in outer sleeve 244, permitting ring 256 to rotate about the axis of the operating string 30. Pin 254 slides within complex slot 250, a development of which is shown in FIG. 5A. FIG. 7, a section taken through line x—x of FIG. 1C, illustrates the manner in which ring 256 is housed between outer sleeve 244 and inner case 246, pin 254 being disposed in slot 250 at the lower end thereof. FIG. 8 shows a section through the assembly of ring 256 and pin 254. The configuration of complex slot 250 permits the crossover tool 240 to be locked in an open or closed mode as will be explained in greater detail hereafter. Briefly, pin 252 in cooperation with slot 248 prevents rotation of the outer sleeve 244 with respect to the inner case 246. Pin 254, when the string is reciprocated, follows the path described by complex slot 250; this can be accomplished because ring 256 permits circumferential movement of pin 254 about case 246, the edges of slot 250 guiding the pin 254 into the several different positions. Outer sleeve 244 possesses annular seals 260, 262 and 264. Seals 260 and 262 bracket circulation ports 266 and 268, which, when the crossover tool 240 is in its open mode, permit communication between upper annulus 270 above the crossover tool 240, and inner bore 272 of the crossover tool 240 via circulation passages 274 and 276 within inner case 246. Inner case 246 possesses vertical passages 278 and 280, depicted by broken lines, which pass from bore 242 to annular bore 282 of the crossover tool. Vertical passages 278 and 280 do not communicate with circulation passages 274 and 276. Inner sleeve 246 also possesses bypass ports 284 and 286, which are bracketed by seals 262 and 264 when crossover tool 240 is in the open mode, as shown in FIG. 1A. When outer sleeve 244 is reciprocated upwardly, and the crossover tool 240 is closed, seal 264 is above bypass ports 284 and 286, thus permitting communication between upper annulus 270 above the crossover tool 240, and the lower annulus 288 between the operating string 30 and screen liner assembly 32. This same motion of outer sleeve 244 isolates circulation passages 274 and 276 via annular seals 260 and 262, as shown in FIG. 2. Bypass ports 284 and 286, when open, allow equalization of pressures in the annulus above and below the crossover tool and, in conjunction with other bypasses in the isolation gravel packer and bypass assembly 320, discussed below, facilitate movement of the operating string 30 within screen liner assembly 32. At the lower end of inner case 246 are disposed packer cups 290 and 292, which face upward, contact the production casing 34 above liner hanger 40, and seal lower annulus 288 below them from greater pressure in upper annulus 270 when reversing circulation after gravel packing. Inner conduit 294 and concentric outer conduit 296 exit from the lower end of crossover tool 240, and mate with inner blank pipe 298 and concentric outer blank pipe 300 which extend downward to isolation gravel packer and bypass assembly 320. Concentric pipes 298 and 300 must be of sufficient length to permit positioning of the isolation gravel packer and bypass assembly 320 (FIG. 1C) across the lowest full open gravel collar 140, while allowing adequate reciprocal motion of the operating string 30 without the crossover tool 240 impinging on liner hanger 240. As the two lengths of pipe cannot be matched exactly, it is of course necessary to include a slip joint and swivel assembly illustrated in simplified form at 302 in the inner string of pipe; inner element 304 slides vertically and rotationally within outer element 306, the two having an annular fluid seal therebetween (not shown).

Figure 1B:
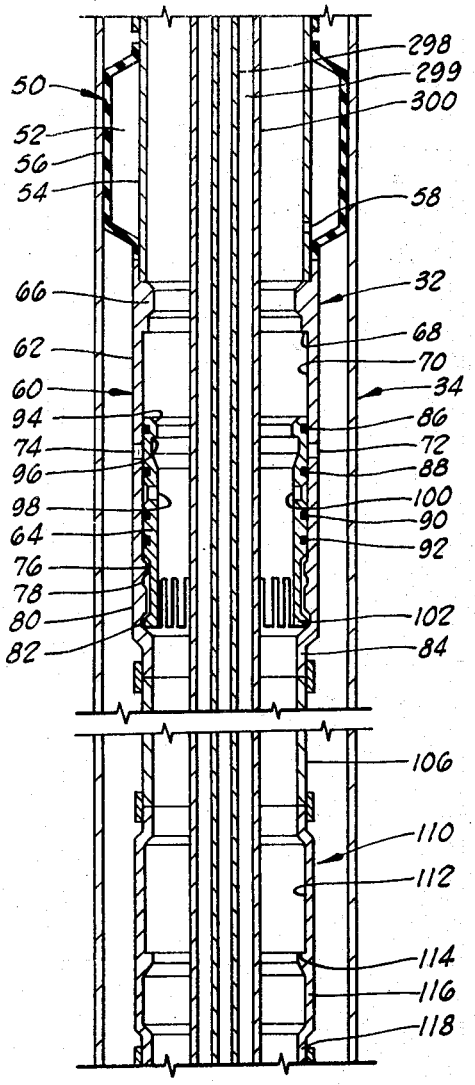
Figure 1C:
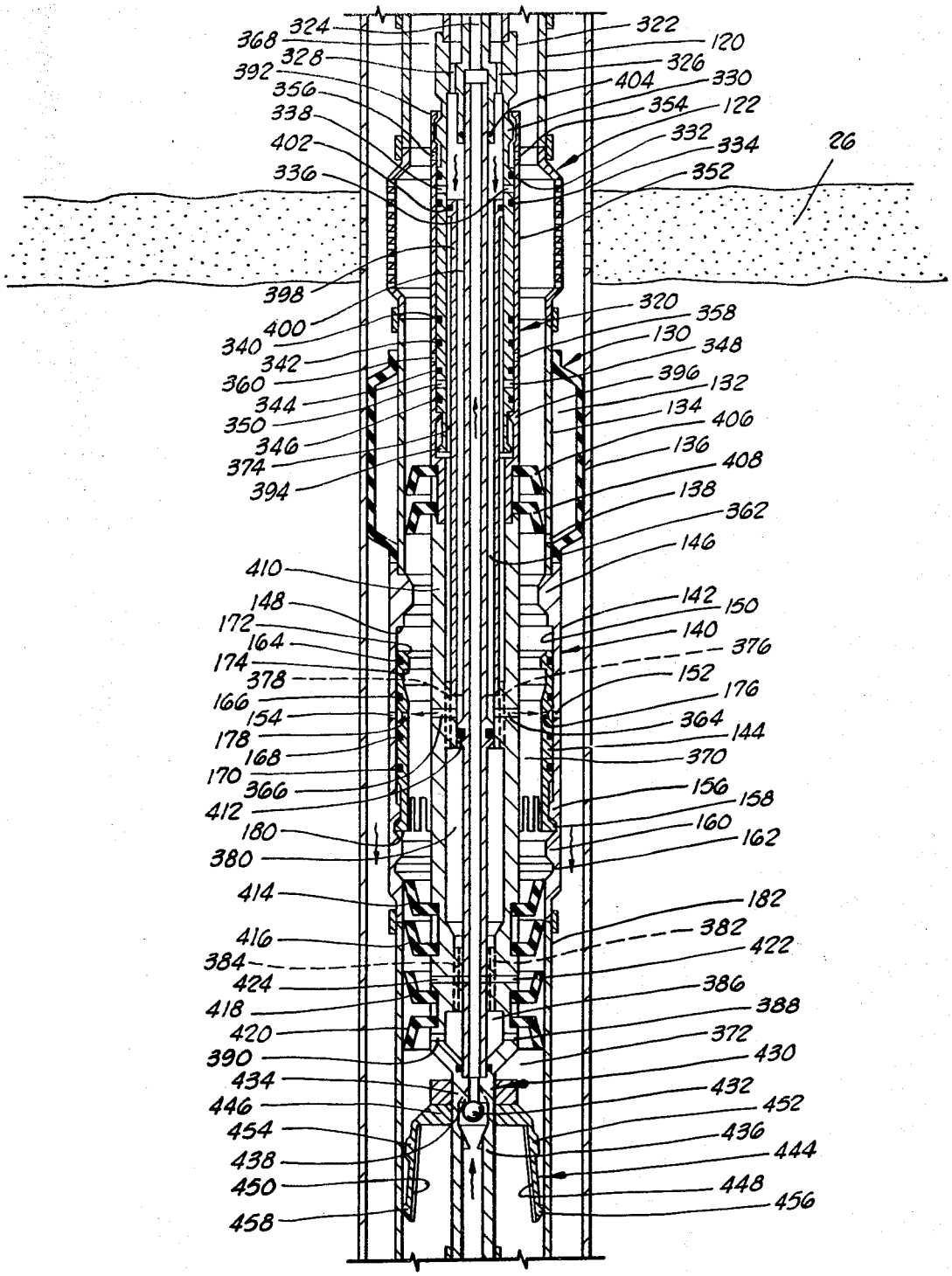
Figure 2:
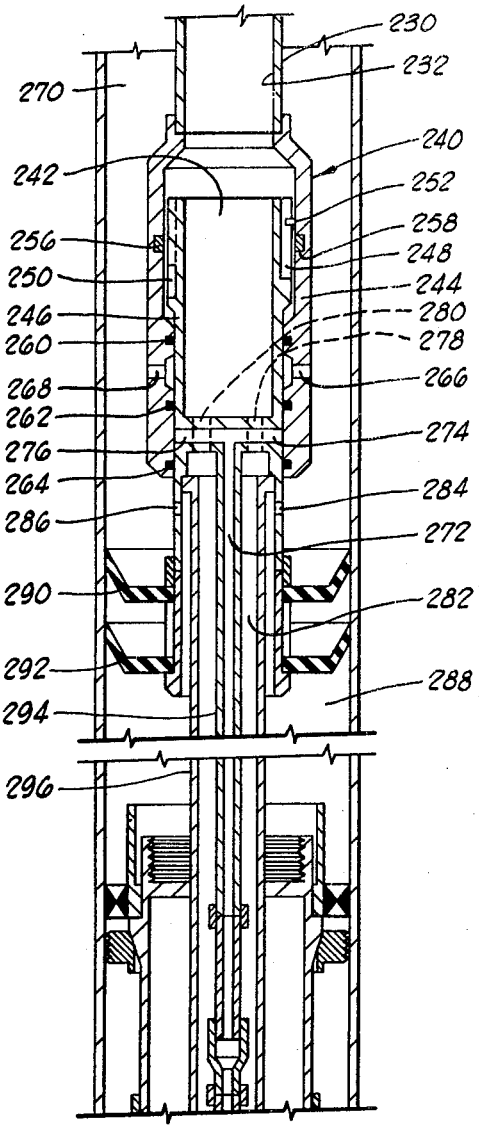
FIG. 2 is a simplified vertical cross-sectional elevation similar to FIG. 1A, but illustrating the crossover tool of the present invention in the closed mode.

Referring to FIGS. 1B and 1C, blank pipes 298 and 300 enter the top of isolation gravel packer and bypass assembly 320, at the top of which is located upper body 322, at which point blank pipe 298 communicates with axial circulation passage 324 and the annulus 299 between pipes 298 and 300 communicates with outer passages 326 and 328.

Below outer passages 326 and 328, upper body 322 possesses a constricted area on its exterior upon which is disposed outwardly facing circumferential shoulder 330. Below circumferential shoulder 330 are disposed annular seals 332 and 334, which bracket bypass ports 336 and 338. Continuing downward, annular seals 340, 342, 344 and 346 are disposed about the lower portion of upper body 322. Bypass ports 348 and 350 are located between seals 344 and 346. Slidably disposed about upper body 322 is bypass valve body 352, through which extend bypass ports 354 and 356 at the upper end thereof, and bypass ports 358 and 360 at the lower end thereof. When pipe 230 is moved upward, thereby pulling upper body 322 upward, ports 336 and 338 in upper body 322 become aligned with ports 354 and 356, respectively, in bypass valve body 352. At the same time, bypass ports 358 and 360 become aligned with bypass ports 348 and 350, respectively, in the lower end of the assembly. When the bypass ports are aligned, the upper bypass port sets permit fluid communication between annulus 368 above the isolation gravel packer and packer annulus 370, through inner annular passage 362 and gravel passages 364 and 366, permitting equalization of pressures and eliminating swabbing when the operating string 30 is raised or lowered in the wellbore. Similarly the lower bypass port sets allow pressures to be equalized between the annulus 368 above the isolation gravel packer and annulus 372 below, via outer annulus passage 374, upper vertical bypass passages 376 and 378, upper annular bypass chamber 380, lower vertical bypass passages 382 and 384, lower annular bypass chamber 386 and lateral bypass passages 388 and 390. In the closed position of the bypasses, a ring of collet fingers 392 at the top of bypass valve body 352 engage shoulder 330 on upper body 322. When in the open position, the inward protrusion at the upper portion of collet fingers 392 abuts the lower edge of shoulder 330 positively holding the bypass open until weight is set down on the operating string 30. Reciprocating motion is limited between bypass valve body 352 and upper body 322 by the abutting of a ring of lugged fingers 394 of the lower end of upper body 322 with the annular shoulder 396 of bypass valve body 352, the aforesaid lugged fingers also preventing relative rotation of the two bodies by engagement with groove (not shown) in bypass valve body 352.

Within both bypass valve body 352 and upper body 322 are disposed sleeve 398 and concentric inner mandrel 400. Annular seal 402 provides a fluid seal between sleeve 398 and upper body 322, while annular seal 404 provides a fluid seal between inner mandrel 400 and upper body 322. Seals 402 and 404 both allow reciprocal movement of upper body 322. Disposed about the exterior of the lower portion of bypass valve body 352 are downwardfacing packer cups 406 and 408. Below packer cups 406 and 408, lower body 410 possesses lateral gravel passages 364 and 366 which communicate with inner passage 362 and are aligned with gravel ports 152 and 154 when the isolation gravel packer and bypass assembly 320 is anchored in place at lower zone 28 adjacent gravel collar 140. Annular seal 412 isolates inner annular passage 362 from upper annular bypass chamber 380.

At the lowermost end of isolation gravel packer and bypass assembly 322 are mounted upward-facing packer cups 414, 416 and 418, and downward-facing packer cup 420 upon lower body 410. Between packer cups 416 and 418 are located lateral circulation passages 422 and 424, which communicate with axial circulation passage 324. As noted previously, lower vertical bypass passages 382 and 384 avoid lateral circulation passages 422 and 424 and permit fluid communication between upper annular bypass chamber 380 and lower annular bypass chamber 386, which in turn exits through lateral bypass passages 388 and 390 to annulus 372 below downward-facing packer cup 420.

Immediately below isolation gravel packer and bypass assembly 320 is ball check valve 430, comprising ball 432, housing 434, and valve seat 436. Bypasses 438 in housing 434 permit fluid flow upward into axial circulation passage 324 from tail pipe 440, but seat 436 halts downward flow when circulation is reversed and ball 432 is forced against it.

At approximately the same location as ball check valve 430 is opening sleeve positioner 444, comprising sleeve positioner body 446 and spring arms 448 and 450 as well as two other arms, not shown, disposed on a vertical plane perpendicular thereto. The use of four such arms is for purposes of illustration, and not to be construed as a limitation on the structure of the opening sleeve positioner or the anchor positioner and closing sleeve positioner described hereafter. Each arm possesses a radially outwardly extending shoulder 452 and 454, with beveled edges. At the ends of the spring arms 448 and 450 are located protrusions 456 and 458, each having an upward-facing radially outward extending shoulder at the top thereof, the lower outside face of each protrusion being beveled inwardly in a downward direction. Spring arms 448 and 450 are shown in a slightly compressed position against the interior of screen liner assembly 32 at polished nipple 182.

Figure 10:
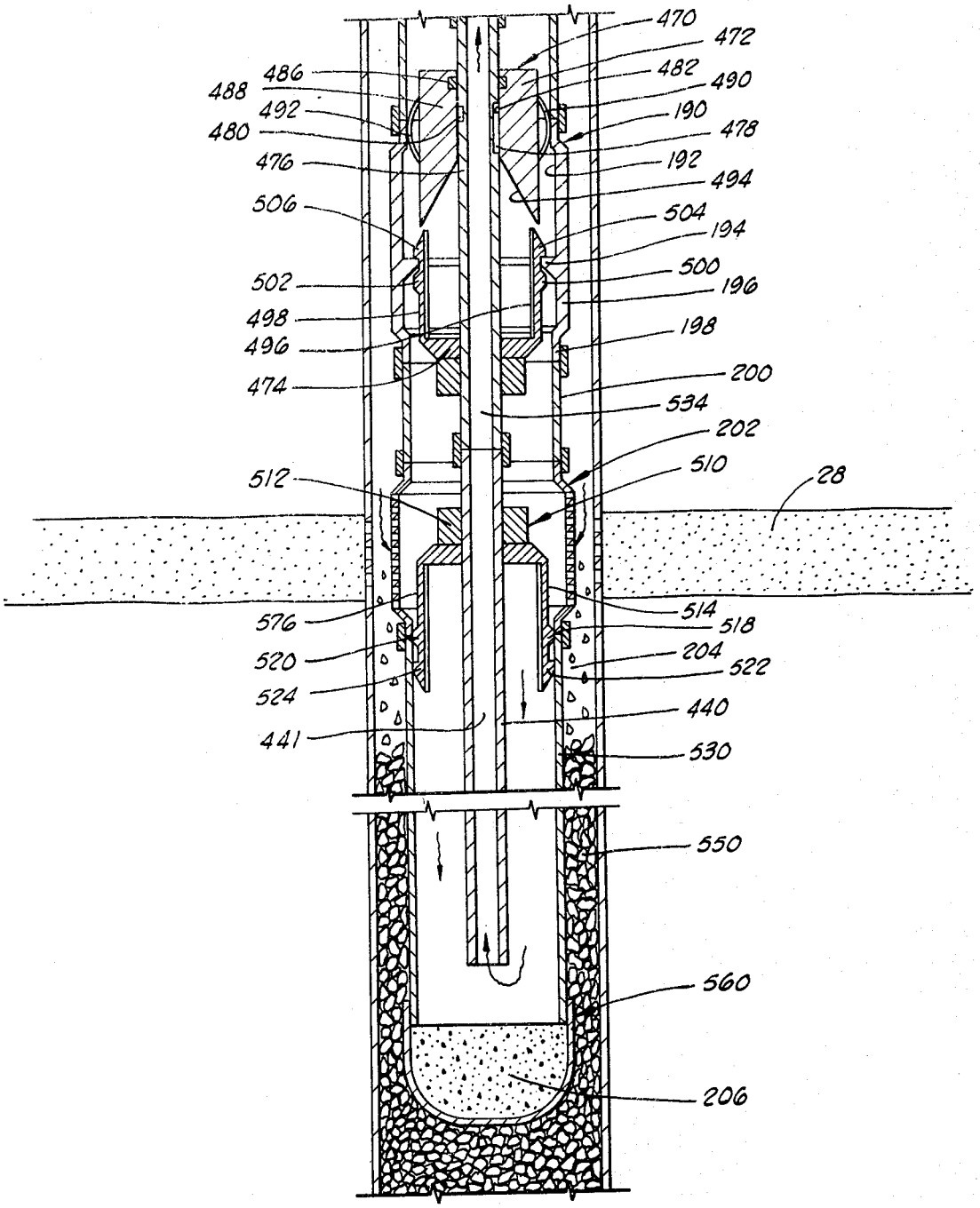
FIG. 10 is a cross-sectional view of the pin and ring assembly of the anchor positioner.
Figure 4:
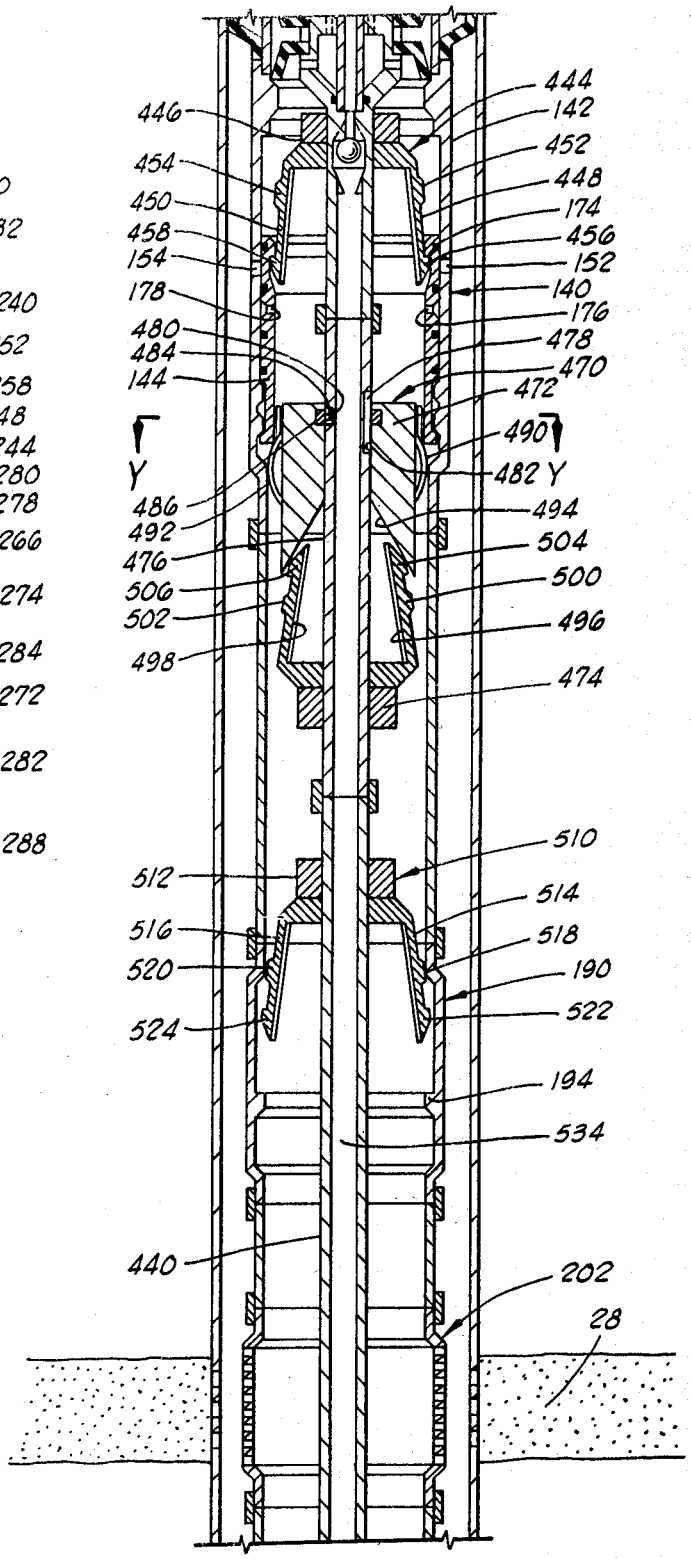
FIG. 4 is a simplified vertical cross-sectional elevation illustrating the anchor positioner in its retract mode and the opening sleeve positioner as it is set to open the full open gravel collar of the screen liner assembly.
Figure 6A:
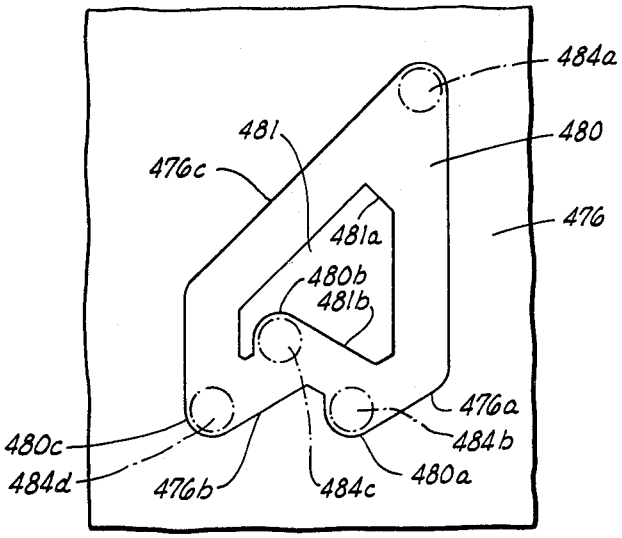
FIGS. 6A and 6B are developments of the slots of the anchor positioner.
Figure 6B:
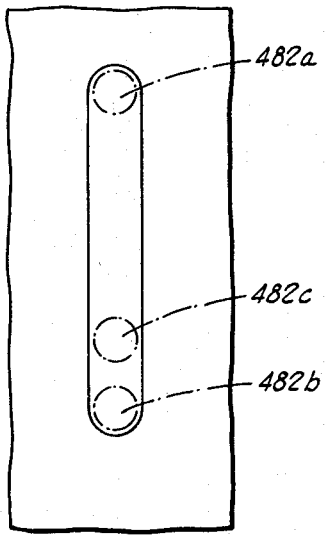
Figure 9:
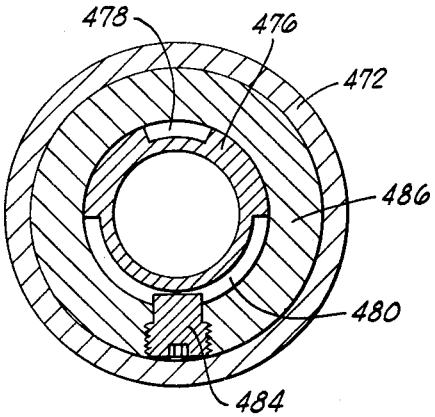
FIG. 9 is a horizontal cross-sectional elevation of the anchor positioner taken on line y—y of FIG. 4.
Figure 10:
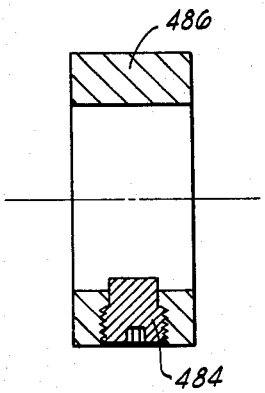

Below opening sleeve positioner 444 in operating string 30 is located anchor positioner 470, comprising drag block assembly 472 and spring arm collar 474. Drag block assembly is slidably mounted on mandrel 476, in which are located slots 478 and 480, developments of which are shown in FIGS. 6A and 6B, respectively. Pin 482 is fixed to drag block assembly 472, and slides within slot 478. Pin 484 (not shown in FIG. 1D, see FIG. 4), is mounted in ring 486 which encircles mandrel 476 and is rotationally slidably housed in annular groove 488 in drag block assembly 472. FIG. 9, a section across line y—y in FIG. 4, illustrates the housing of ring 486 and pin 484 between drag block assembly 472 and mandrel 476. FIG. 10 is a section of the ring and pin assembly alone. The ring-pin combination permits pin 484 to move circumferentially as well as axially, following the edges of slot 480 to permit drag block assembly 472 to reciprocate up and down on mandrel 476, and to be locked in several different modes, as will be explained in greater detail hereafter. On the exterior of drag block assembly 472 are spring-loaded drag blocks 490 and 492, shown schematically, which press against the inside of screen liner assembly 32, thus centering the anchor positioner 470. The lower face 494 of drag block assembly 472 is frusto-conical in configuration, being inclined inwardly and upwardly from the lowest extremity thereof. Below drag block assembly 472, spring arm collar 474 possesses upward-facing spring arms 496 and 498 (as well as two others on a perpendicular vertical plane), similar to those of opening sleeve positioner 444. Spring arms 496 and 498 possess radially outward extending shoulders 500 and 502, as well as protrusions 504 and 506 at their upper ends. The shoulders 500 and 502 have beveled edges, and the protrusions have downward-facing radially outward extending shoulders at the bottom, and upwardly extending inwardly-beveled faces at the top. The uppermost points of these faces are disposed on a radius less than the lowermost extremity of drag block assembly 472, thus permitting the inclined face 494 to slidably engage and compress the spring arms 496 and 498 when operating string 30 is pulled upward as shown in FIG. 4. Spring arms 496 and 498 are shown engaged with anchor tool 190 in FIG. 1D.

Below anchor positioner 470 is located closing sleeve positioner 510, comprising positioner body 512 on which are mounted downward-facing spring arms 514 and 516 (as well as two others, not shown). Each spring arm 514 and 516 possesses outward radially extending shoulders 518 and 520, the edges of which are beveled. At the lowest end of the spring arms 514 and 516 are protrusions, 522 and 524, having upward-facing outwardly radially extending shoulders at their upper edges, and downward inwardly beveled edges on their lowermost exteriors. Spring arms 514 and 516 are shown in slightly compressed positions against the interior of screen liner assembly 32 at blank end pipe 530.

At the lowest extremity of operating string 30 is tail pipe 440, having bore 532 which communicates with bore 534 extending through anchor positioner mandrel 476 up to check valve 430.

OPERATION

Referring again to the drawings, the operation of the present invention will be described. After the well is drilled and casing 34 inserted it is perforated at the appropriate intervals adjacent formations 26 and 28, washed and possibly treated in some manner. At this point, screen liner assembly 32 is lowered into the well bore and hung within casing 34 by liner hanger assembly 40.

The screen liner assembly 32 as installed in the casing, comprises as many full open gravel collars as there are zones to be packed, as shown in the present instance by reference characters 60 and 140. As stated previously, the gravel collars 60 and 140 are located above their respective zones to be packed, while corresponding gravel screens 122 and 202 are located adjacent to and spanning these zones. Between each gravel collar and its corresponding gravel screen are located polished nipples 100 and 182, and anchor tools 110 and 190, respectively, which accurately position the operating string 30 at each zone when the anchor positioner assembly 470 is engaged in the appropriate anchor tool.

Above the upper zone is located suitable casing inflation packer 50, and below the zone is suitable casing inflation packer 130, which, when inflated isolate the upper zone from the zone below and the well annulus above. If the upper zone is extremely close to liner hanger assembly 40, packer 50 may be deleted as redundant when a liner hanger with a sealing element is employed such as illustrated schematically at 42. If it is desired to isolate zones not only from each other but from the intervals between formations, packers may be employed above and below each zone. For example, if the upper zone in the present instance was far above the lower zone, an additional casing inflation packer might be utilized in the screen liner assembly 32 above packer 130 and yet below the upper zone.

After the screen liner assembly 32 is hung in the casing, the operating string 30 is run into the well bore. The operator has the option of inflating casing inflation packers 50 and 130 as the operating string 30 is going down the well bore, or he may elect to inflate the packers from the bottom as he proceeds upward. He may, in fact, inflate the packers in any order but for purposes of discussion the methods of inflating packers from the bottom up and top down will be more fully described hereinafter.

Before proceeding with the description of inflation packers 50 and 130, however, the operation of the crossover tool 240 and anchor positioner 470 will be discussed in detail.

FIGS. 1A, 2, 5A, 5B and 7 are of particular relevance to the understanding of the operation of crossover tool 240, which utilizes an internal rotating slot mechanism, as previously stated. Outer sleeve 244 being slidably disposed about inner case 246, movement of the outer sleeve 244 by virtue of reciprocation of drill pipe 230 effects changes of mode in crossover tool 240 from open to closed and vice-versa. When crossover tool 240 is in the open mode as shown in FIG. 1A, circulation ports 266 and 268 in outer sleeve 244 are aligned with circulation passages 274 and 276, respectively, which extend through inner case 246 and themselves communicate with inner bore 272. In the open mode, circulation passages are bracketed by annular seals 260 and 262, while seals 262 and 264 bracket bypass ports 284 and 286 in inner case 246 below circulation passages 274 and 276, thus isolating annulus 270 from annulus 288 below crossover tool 240. When crossover tool 240 is in the closed mode, as shown in FIG. 2, circulation passages 274 and 276 are bracketed by annular seals 262 and 264, thus closing them off from annulus 270, while bypass ports 284 and 286 are opened. To ensure positive locking in the open and closed modes of crossover tool 240, the slot mechanisms illustrated in FIGS. 5A, 5B, and 7 are employed. To ensure that outer sleeve 244 will not rotate with respect to inner case 246, fixed pin 252 in outer sleeve 244 slides within straight slot 248 in inner casing 246. A development of straight slot 248 is shown in FIG. 5B. To provide positive locking in each tool mode, complex slot 250 in inner case 246 is utilized with pin 254 and ring 256. Ring 256 is rotationally slidably confined within annulus 258 in outer sleeve 244. Thus, when outer sleeve 244 is reciprocated, pin 254 follows the edges of complex slot 250 and defined by inner case 246 and cam island 251 by virtue of the rotational and axial movement capabilities allowed by ring 256. When crossover tool 240 is in the open mode as illustrated in FIG. 1A, pin 254 is at position **254*a* in complex slot 250 as shown in FIG. 5A, while pin 252 in straight slot 248 is in position 252*a* as shown in FIG. 5B. FIG. 7 also illustrates the position of pin 254 in slot 250 when crossover tool 240 is in the open mode. Straight slot 248 is not shown, as the section is taken below it. When drill pipe 230 and therefore outer sleeve 244 are reciprocated upward, pin 254 is guided to position 254*b*** in slot recess 250*a* by angled edge 251*a* of cam island 251 and angled perimeter slot edge 246*a* to position 254*b*, while pin 252 moves to position 252*b*, closing crossover tool 240, as shown in FIG. 2. When the drill pipe 230 is set down, pin 254 is guided into position 254*c* in slot recess 250*b* by angled cam island edge 251*b*. Pin 252 also, obviously, moves downward to position 252*c* in straight slot 248. When it is desired to open crossover tool 240 again, upward reciprocation of outer sleeve 244 causes pin 254 to be guided into location 254*d* in slot 250 by angled perimeter slot edge 246*b*, after which downward movement of outer sleeve 244 drops pin 254 down to position 254*a*. Pin 254 is prevented from returning to position 254*c* by angled cam island edge 251*c*, and then follows angled perimeter slot edge 246*c* to position 254*a*. Pin 252, of course, goes to position 252*b* and then 252*a* in straight slot 248 in the same sequence. It may be noted, should the operator wish to ensure that bypass ports 284 and 286 remain open while running the operating string in the well, whether crossover tool 240 is locked in the closed mode, snap-ring collet mechanism, such as that depicted in FIGS. 14 and 15, may be incorporated in the crossover tool in addition to the complex slot mechanism by elongating both casing and sleeve and placing the snap-ring and collet below the slots. In this manner, even assuming that pin 254 is in location 254*d*, it will not slide down to position 254*a* until a predetermined weight (for example, 20,000 pounds as used to close the bypasses in isolation gravel packer 320) focus outer sleeve 244 downward, overcoming the snap-ring, which had previously "propped up" outer sleeve 244. The manner of effecting such modification is, of course, evident to one skilled in the art.

Referring to FIGS. 1D, 4, 6A, 6B and 9, it will now be shown how the reciprocation of the operating string effects the change of mode of the anchor positioner 470 from retract to release. As previously stated, the anchor positioner 470 is activated by an internal rotating slot mechanism. As shown in FIG. 1D, mandrel 476 possesses slots 478 and 480, developments of which are shown in FIG. 6A and FIG. 6B, respectively. Straight slot 478, in conjunction with pin 482, which is fixedly mounted to drag block assembly 472, permits an up and down, or reciprocating, motion of the operating string 30 and hence of mandrel 476 with respect to the drag block assembly 472 while preventing rotational motion of drag block assembly 472. Complex slot 480, on the other hand, is engaged by pin 484 (not shown on FIG. 1D, but shown on FIG. 4) which is fixed to ring 486 which in turn is slidably housed between mandrel 476 and drag block assembly 472 in housing 488. Since rotational motion of the drag block assembly 472 is prevented by pin 482 in slot 478, when the operating string 30 is reciprocated, pin 484 will follow the edges of complex slot 480 defined by mandrel 476 and cam island 481, being permitted to do so by the rotation of ring 486 in housing 488. Referring now to FIG. 6A, it is apparent that the position of pin 484 as shown at 484*a* in broken lines will coincide with the anchor positioner 470 being in its released position (FIG. 1D), as drag block assembly 472 is held away from spring arms 496 and 498 by drag blocks 490 and 492 and pressing against the wall of anchor tool 190. At the same time, fixed pin 482 is in position 482*a* in slot 478 as shown in FIG. 6B. To place the anchor positioner assembly 470 in the retract position, the operating string 30 and hence mandrel 476 is pulled upward, thereby moving pin 484 relatively downward in complex slot 480 to position 484*b*, wherein the inclined face 494 of drag block assembly slidably engages and compresses spring arms 496 and 498. At this instance, fixed pin 482 has moved to position 482*b* in slot 478. Anchor positioner 470 is now in the retract mode as shown in FIG. 4. Pin 484 is prevented from moving to position 484*d* by angled cam island edge 481*a* and is guided to position 484*b* in slot recess 480*a* by angled perimeter slot edge 476*a*. To lock the anchor positioner 470 in the retract mode, operating string 30 and hence mandrel 410 is moved downwardly, whereby pin 484 is guided relatively upward into position 484*c* in slot recess 480*b* by angled cam island edge 481*b*, and pin 482 has moved to position 482*c*. To release anchor positioner 470 again, operating string 30 need only be moved upward and then downward, to release the pin 484 to position 484*d* in slot recess 480*c* (guided by edge 476*b*) and then back to 484*a* (guided by edge 476*c*) where the drag block assembly 472 has disengaged spring arms 496 and 498. Pin 482 returns to position 482*b*, then to 482*a* in this sequence. Referring to FIG. 9 for further clarification, a section is shown across line y—y of FIG. 4. Pin 484 is in position 484*c* at the bottom of complex slot 480, and is rotatably mounted between mandrel 476 and drag block assembly 472 of anchor positioner 470 by its attachment to ring 486. Straight slot 478 is shown at the top of FIG. 9, while complex slot 480 is at the bottom.

The manner in which packers 50 and 130 may be inflated from the lowest upward will now be described, with particular reference to FIGS. 1C and 1D. With anchor positioner 470 in its retract mode, operating string 30 is lowered to the approximate location of the lowest zone and anchor tool 190. The operating string 30 is then reciprocated upward to effect the release mode, and anchor positioner is then lowered to engage anchor tool 190. If the anchor positioner happens to be released below anchor tool 190, it may be raised through it even in the release mode, as the inclined outer edges of protrusions 504 and 506 will guide spring arms 496 and 498 past shoulder 194 of anchor tool 190. Anchor positioner 470 is locked in position when downward-facing shoulders on protrusions 504 and 506 are resting on shoulder 194. At this point, unlike FIG. 1C, full open gravel collar 140 will be closed (as shown in FIG. 4), as no steps have yet been taken to open it. Thus, inflation port 138 of casing inflation packer 130 is spanned by downward-facing packer cups 406 and 408 and upward-facing packer cups 414 and 416 of isolation gravel packer and bypass assembly 320. As the packer cannot be inflated while the bypass ports in isolation gravel packer and bypass assembly 320 are open, it is necessary to set approximately 20,000 pounds of weight on the anchor to close them. When the weight is set, upper body 322 moves downwardly with respect to bypass valve body 352, to the position shown in FIG. 1C, isolating ports 354, 356 and 358 and 360 in bypass valve body 352 from ports 336, 338, 348 and 350, respectively, in upper body 322, annular seals 332, 334, 340, 342, 344 and 346 preventing fluid movement between annulus 368, and packer annulus 370 and annulus 372 below isolation gravel packer and bypass assembly 320. As crossover tool 240 (see FIG. 1A) is in the open mode annular seals 262 and 264 isolate bypass ports 284 and 286, cutting off fluid communication between annulus 270 and annulus 288. However, should crossover tool 240 be in its closed mode (FIG. 2), inflation may still proceed even with bypass ports 284 and 286 open. All necessary bypass ports being closed, the operating string 30 is then pressured to the desired pressure through pipe 230 to inflate casing inflation packer 130. The pressurized fluid reaches packer 130 through annular bore 282, outer blank pipe annulus 299, outer passages 326 and 328, inner annular passage 362, then gravel passages 364 and 366 which exit into packer annulus 370 defined by the interior of screen liner assembly 32, the exterior of operating string 30, packer cups 406 and 408 at the top, and 414 and 416 at the bottom. From annulus cavity 370, fluid enters casing inflation packer 130 through check valve 138, inflating it to a predetermined pressure. The casing inflation packer being inflated, gravel packing may now proceed at the lowest zone as described hereafter. Alternately, if the operator desires to inflate packers 50 and 130 as the operating string 30 proceeds into the well bore, he engages the shoulder 114 of uppermost anchor 110 with spring arms 496 and 498 of anchor positioner 470. The spring arms 496 and 498 will automatically engage if the anchor positioner 470 is in the release mode (as shown in FIG. 1D), the downward-facing shoulders on protrusions 504 and 506 engaging annular shoulder 114 of the anchor tool 110, thereby automatically locating the operating string 30 in the proper position in the well bore. If the anchor positioner is in the retract mode (as shown in FIG. 4) with spring arms 496 and 498 compressed by inclined face 494 of drag block assembly 472, the operating string 30 will pass through anchor tool 110 without engaging it. If this occurs, it is necessary to pick up the operating string to release the spring arms 496 and 498, after which the anchor positioner 470 is lowered to engage the anchor tool 110. If the anchor positioner 470 is released below anchor 110, it will pass up through anchor 110 and the inclined outer edges of protrusions 504 and 506 will guide spring arms 496 and 498 past shoulder 114 of anchor tool 110.

The ports 72 and 74 of full open gravel collar 60 will be closed, as shown in FIG. 1B, with the inflation port 58 of packer 50 being spanned by downward-facing cups 406 and 408 and upward-facing cups 414 and 416 of isolation gravel packer and bypass assembly 320. To close the bypass ports in the isolation gravel packer and bypass assembly, it is necessary to set approximately 20,000 pounds of weight on the anchor, as noted previously. When the weight is set, upper body 322 moves downwardly with respect to bypass valve body 352, thereby isolating ports 354, 356, 358 and 360 in bypass valve body 352 from ports 336, 338, 348 and 350, respectively, in upper body 322, annular seals 332, 334, 340, 342, 344 and 346 preventing fluid movement between annulus 368 and packer annulus 370 and annulus 372. With the bypass ports closed, in isolation gravel packer and bypass assembly 320, the operating string 30 is then pressured to the desired pressure through pipe 230 to inflate casing inflation packer 50. The pressurized fluid reaches packer 50 through annular bore 282, outer blank pipe annulus 299, outer passages 326 and 328, inner annular passage 362, gravel passages 364 and 366 which exit into a packer annular cavity 370 defined by the screen liner assembly 32, operating string 30, and packer cups 406 and 408 at the top and 414 and 416 at the bottom. The fluid then enters casing inflation packer 50 through check valve 58, inflating it to a predetermined pressure. After the packer is inflated, the operating string is ready to proceed down to the next casing inflation packer 130.

To release the anchor positioner assembly 470, the operating string 30 is reciprocated upward by picking up pipe 230 four to six feet, at which time the bypass ports in isolation gravel packer and bypass assembly 320 open as well as those in crossover tool 240, if not already open (that being the case if crossover tool 240 is already in the closed mode) to permit equalization of pressures. As the bypass ports in isolation gravel packer 320 are collet retained, and those in the crossover tool 240 may be by a snap-ring collet abutment (as previously described), they will remain open until the next time weight is set down on the operating string 30.

The operating string 30 is lowered to the approximate location of anchor tool 190, reciprocated again to release anchor positioner 470, and lowered to the point where spring arms 496 and 498 engage annular shoulder 194 and take weight. At this point, 20,000 pounds is set down to close all necessary bypass ports in isolation gravel packer and bypass assembly 320, and the operating string is once again pressured to inflate packer 130 through check valve 138. As shown in FIG. 1C, packer annulus 370 is defined by operating string 30, screen liner assembly 32, packer cups 406 and 408 at the top and packer cups 414 and 416 at the bottom. The cavity 370 is pressured through gravel passages 364 and 366, as previously described. At this point, as all of the inflation packers have been inflated, gravel packing may proceed.

Full open gravel collar 140 is opened by reciprocating operating string 30 to retract the anchor positioner 470, and raising the operating string 30 so that opening sleeve positioner 444 engages sleeve 144 of full open gravel collar 140. Spring arms 448 and 450 of opening positioner 444 expand and the shoulders on protrusions 456 and 458 engage annular shoulder 174 on sleeve 144. A pull of approximately 10,000 pounds will align apertures 176 and 178 of sleeve 144 with gravel ports 152 and 154 of case 142, thereby opening the gravel collar 140. As the open position of full open gravel collar 140 is reached, radially outward extending shoulders 452 and 454 have contacted the beveled edge leading to necked-down portion 146, which contact compresses spring arms 448 and 450, causing them to release from sleeve 144, leaving gravel collar 140 in the open position. The operating string 30 is then lowered to the approximate location of the anchor 190, then picked up again to release the anchor positioner 470, and lowered until the anchor positioner 470 is locked in anchor 190.

At this point, gravel packing may begin, provided that the crossover tool is in the proper position. Crossover tool 240 is also operated by up and down, or reciprocating, motion, as previously described. However, the force required to index the crossover tool 240 from one mode to another is less than that required to index the anchor positioner 470. As the crossover is indexed when the anchor positioner 470 is set in an anchor tool, there is a constraint against upward motion, thereby permitting proper indexing of the crossover tool 240. To ascertain if crossover tool 240 is in the open mode, whereby circulation passages 274 and 276 in inner casing 246 communicate with circulation ports 266 and 268 in outer sleeve 244, the operator pressures down drill pipe 230. If the crossover tool 240 is open, fluid will circulate down pipe bore 232, through crossover bore 242, vertical passages 278 and 280, crossover annulus 282, blank pipe annulus 299, outer passages 326 and 228, inner annulus 362, gravel passages 364 and 366 into packer annulus 370, out through gravel ports 152 and 154 into lower zone annulus 550 between casing 34 and screen liner assembly 32 back into the screen liner assembly 32 through gravel screen 202, into bore 441 of tail pipe 440, mandrel bore 534, check valve 430, axial circulation passage 324, and up to the crossover tool 240 through blank pipe 298, then back to the surface. If crossover tool 240 is closed the circulation path will be the same, but back pressure will result as seals 262 and 264 will prevent fluid from passing through passages 274 and 276 as shown in FIG. 2. If closed, upward and then downward reciprocation of drill pipe 230 will suffice to open crossover tool 240.

Assuming that the operator now has crossover tool 240 in its open mode, gravel packing may now be effected. A slurry of carrier fluid containing gravel is pumped down pipe bore 232 and through crossover tool 240 via vertical passages 278 and 280 into crossover annulus 282, blank pipe annulus 299 into passages 326 and 328, inner annular passage 362 and out through gravel passages 364 and 366 into packer annulus 370, then through gravel ports 152 and 154, of full open gravel collar 140 into lower zone annulus 550, where the gravel is deposited. The carrier fluid returns into screen liner assembly 32 through gravel screen 202, the gravel being retained on the outside of the screen 202 by virtue of the proper sizing of the apertures thereof. The gravel-free carrier fluid then enters tail pipe bore 441, and returns past ball check valve 430 which is unseated by fluid passing in an upward direction. The fluid then proceeds through axial circulation passage 324 in isolation gravel packer and bypass assembly 320, then up through inner blank pipe 298 to inner crossover bore 272, through circulation passages 274 and 276 and circulation ports 266 and 268, respectively, into annulus 270, then to the surface. Circulation of the gravel slurry is continued to build up a gravel pack from below gravel screen 202 to a point above it, thus interposing a barrier to sand migration from the zone into the liner assembly 32. When pressure resistance is noted at the surface, this indicates that gravel in the lower zone has been deposited (packed) higher than the top of gravel screen 202, and the pack has been completed. It is evident that no fluid movement has been induced across upper zone 26, during packing, as both gravel slurry and returns are contained within the operating string 30.

Figure 3:
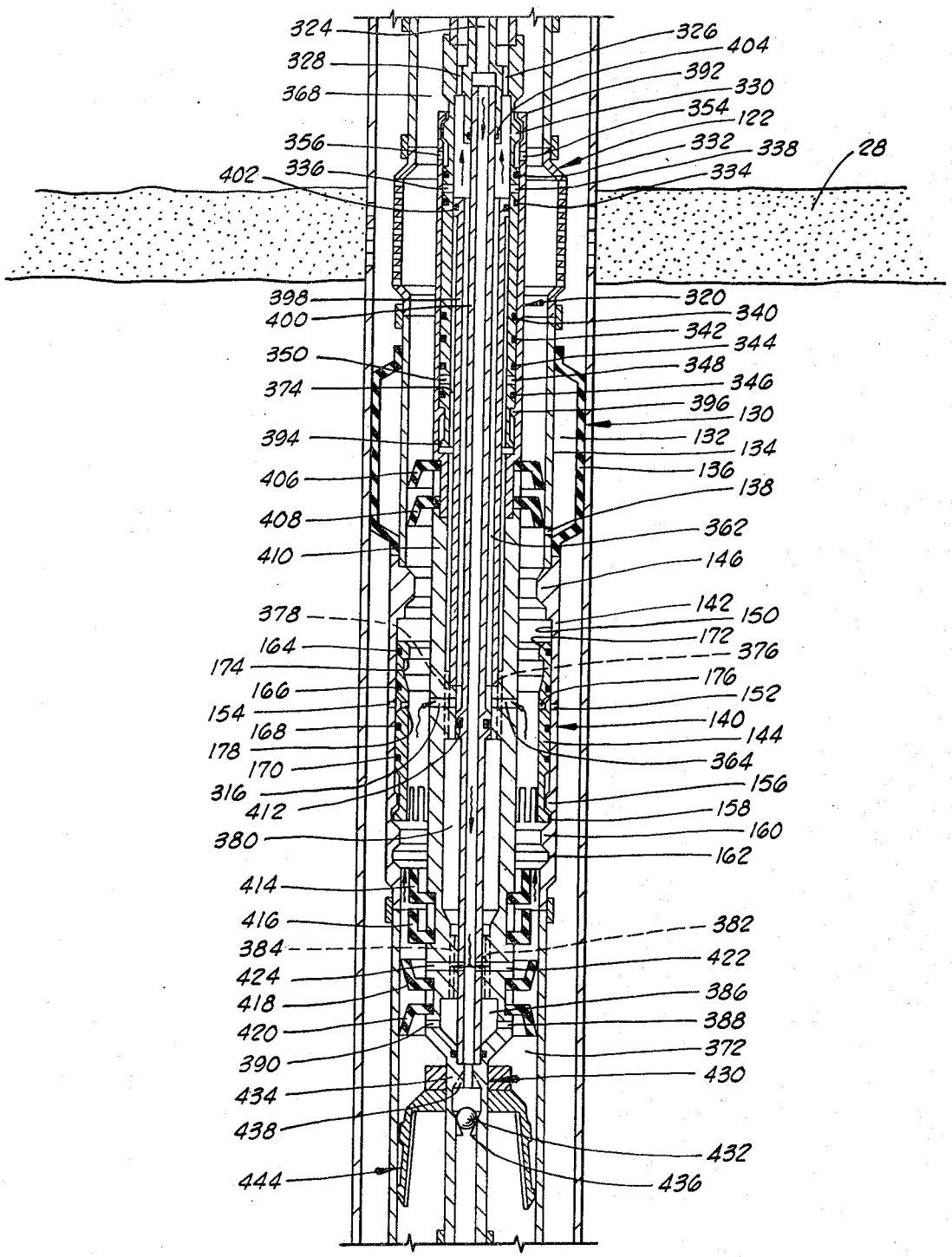
FIG. 3 is a simplified vertical cross-sectional elevation illustrating the isolation gravel packer during reverse circulation after gravel packing has been effected.

If desired at this point, the gravel pack may be further consolidated by applying pressure to it, referred to as squeezing. To effect this, crossover tool 240 is reciprocated up and then down to close it, or annulus 270 closed at the surface, and pressure applied down the drill pipe 230. This pressure will act upon the pack through the same circulation path as described previously. Fluid is contained below isolation gravel packer and bypass assembly 320 by downward-facing packer cup 420, as during normal circulation with crossover tool 240 open. In order to clear the interior of the operating string 30 of residue, circulation is then reversed using a clean fluid. This operation is illustrated in FIG. 3. No movement in the well bore is required to effect this operation, the only action on the part of the operator being necessary is an upward and downward reciprocation of the drill pipe 230 to reopen crossover tool 240 if a squeeze has been applied to the pack. Clean fluid is sent down annulus 270, through circulation ports 266 and 268, circulation passages 274 and 276, and down inner crossover bore 272 through blank pipe 298 to axial circulation passage 324 in isolation gravel packer and bypass assembly 320. When the fluid reaches check valve 430, ball 432 is seated on valve seat 436 preventing flow downward. At this point, the clean fluid will then exit isolation gravel packer and bypass assembly 320 through lateral circulation passages 422 and 424, and flow upward past collapsed packer cups 414 and 416, and back through gravel passages 364 and 366 into inner annular passage 362, through outer passages 326 and 328 to blank pipe annulus 299 through annular crossover bore 282, vertical passages 278 and 280 to the surface through drill pipe bore 232. When clean fluid is returned to the surface, the packing job is complete. It is noteworthy that the reversing fluid is prevented from circulating below isolation gravel packer 320 by upward-facing packer cup 418, responsive to the pressure of fluid flow through lateral circulation passages 422 and 424, and as a result of this seal as well as the closing of check valve 430, reverse circulation is effected without fluid movement across the zone just packed.

At this point, the operating string may be moved upward to the next zone of interest 26, in this case between casing inflation packers 50 and 130. The operating string 30 is reciprocated upward, thus retracting the anchor positioner 470 and disengaging anchor tool 190. As the operating string 30 is pulled up to the next zone, the passing spring arms 514 and 516 of closing sleeve positioner 510 pulls sleeve 144 of full open gravel collar 140 upward. The upward facing outwardly radially extending shoulders of protrusions 522 and 524 on spring arms 514 and 516 engage downward facing annular shoulder 174 in sleeve 144. As the operating string is pulled up, the spring arms 514 and 516 close gravel collar 140, at which point shoulders 518 and 520 encounter necked-down portion 146 of gravel collar 140, which compresses spring arms 514 and 516, releasing them from shoulder 174 of sleeve 144. At this point, annular seals 168 and 170 bracket gravel ports 152 and 154, sealing them. The operating string 30 is then pulled up to the next zone, where it is reciprocated downward briefly, and then upward again, lowered downward into anchor tool 110. If the casing inflation packer 50 above the upper zone has been previously inflated, this final upward reciprocation can effect the opening of gravel collar 60, by engaging sleeve 64 with spring arms 448 and 450 of opening sleeve positioner 444. As noted previously, when spring arms 448 and 450 have opened the collar 60 by pulling sleeve 64 upward, they will automatically disengage as shoulders 452 and 454 encounter necked-down portion 66 which will in turn compress spring arms 448 and 450.

When the anchor positioner 470 has engaged anchor 110, gravel packing may proceed at this zone, the packer 50 above it having previously been inflated. Crossover tool 240 must, of course, be in the open position, which may be ascertained as previously noted herein. After packing of the upper zone of interest is effected, the operating string 30 is withdrawn and the well may be produced.

DESCRIPTION AND OPERATION OF ALTERNATIVE EMBODIMENTS

Figure 11:
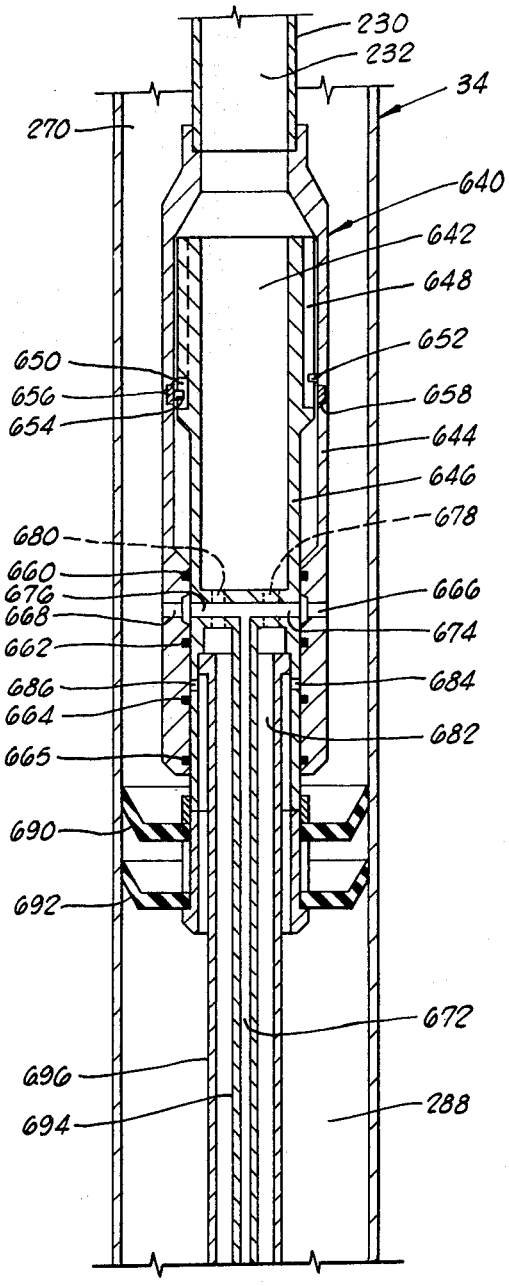
FIG. 11 is a simplified vertical cross-sectional elevation illustrating an alternative embodiment of the crossover tool of the present invention in the open mode.
Figure 12:
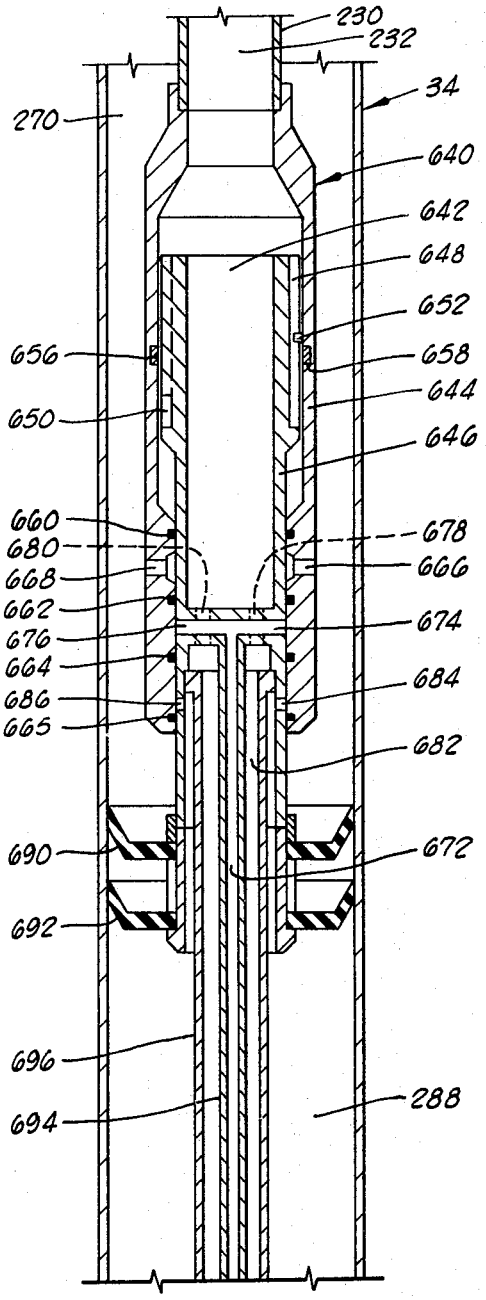
FIG. 12 is a simplified vertical cross-sectional elevation illustrating the alternative embodiment of FIG. 11 in the closed mode with bypass ports closed.
Figure 13:
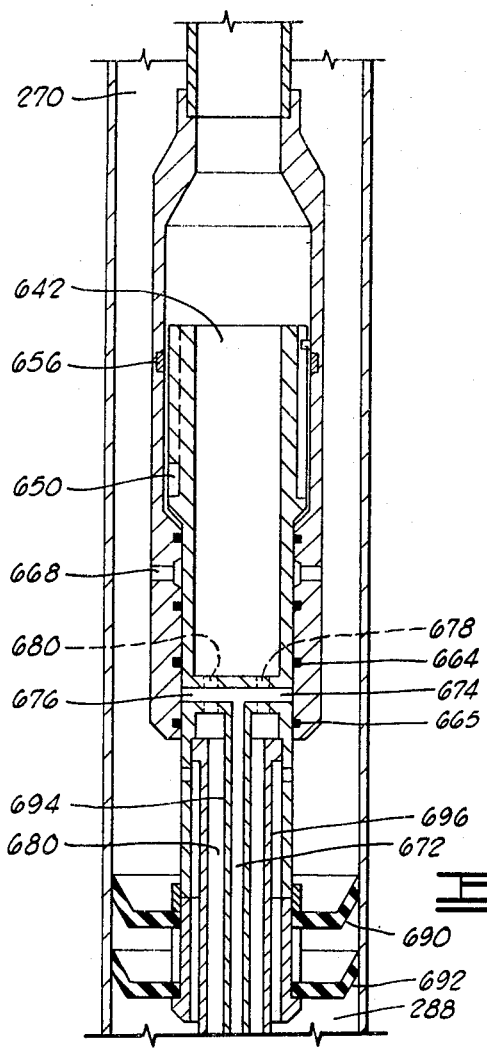
FIG. 13 is a simplified vertical cross-sectional elevation illustrating the alternative embodiment of FIG. 11 in the closed mode with bypass ports open.
Figure 14A:
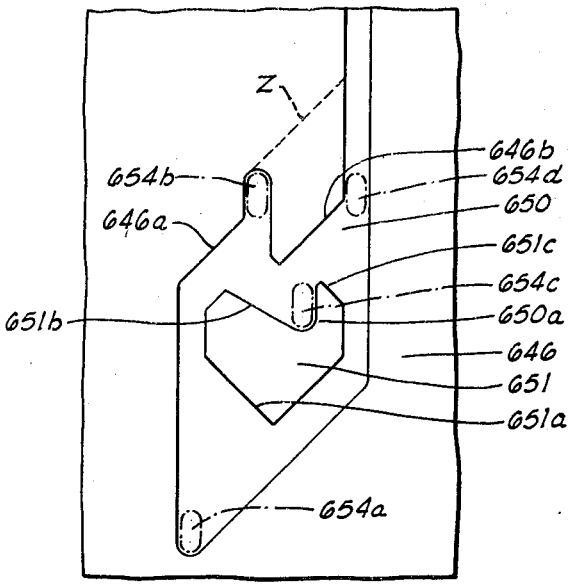
FIGS. 14A and 14B are developments of the slots of the alternative embodiment of the crossover tool illustrated in FIGS. 11, 12 and 13.
Figure 14B:
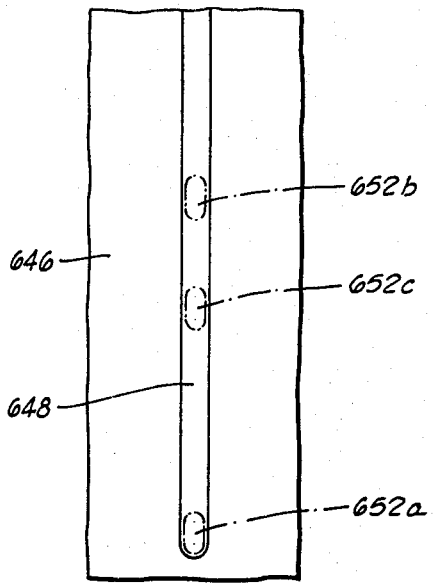

Should one wish to have the ability to avoid any circulation across the zone to be packed even before gravel packing, and be able to more quickly and easily ascertain the mode of the crossover tool, an alternative embodiment of crossover tool 240 as shown in FIGS. 11, 12, 13, 14A and 14B may be employed. This crossover tool, designated generally by the reference character 640, is located in the same position in the operating string 30 as crossover tool 240 in lieu thereof, and is connected to drill pipe 230 and the lower portion of operating string 30 in the same fashion. It comprises outer sleeve 644 and inner case 646. Outer sleeve 644 is slidably disposed about inner case 646, and the opening and closing of the crossover tool 640 is effected by reciprocation of outer sleeve 644 through the movement of pipe 230 on the surface. Inner case 646 has two slots, 648 and 650 in its outer surface. Developments of these slots are illustrated in FIGS. 14A and 14B. These slots slidably engage pins 652 and 654, respectively, which are attached to outer sleeve 644. Pin 652 slides axially in slot 648, and is fixed to outer sleeve 644. Pin 654 is fixed to ring 656, which may slidably rotate in annular recess 658 in outer sleeve 644. Pin 654 may also slide axially in slot 650, the rotational ability given by ring 656 permitting it to move laterally (actually circumferentially) in slot 650, which is "wrapped" around inner case 646 in the same manner as slots 248 and 250 on case 246 of crossover tool 240. Slot 650 as slot 250 in crossover tool 240, is of complex design and permits crossover tool 640 to be locked in several different modes, the achievement of which will be described below. Outer sleeve 644 possesses annular seals 660, 662, 664 and 665. Seals 660 and 662 bracket circulation ports 666 and 668, which, when the crossover tool 640 is in its open mode (as illustrated in FIG. 11) permits communication between annulus 270 above crossover tool 640, and inner bore 672 via circulation passages 674 and 676 within inner case 646. Inner case 646 possesses vertical passages 678 and 680, depicted by broken lines, which pass from bore 642 to annular bore 682 of the crossover tool 640. Vertical passages 678 and 680 do not communicate with circulation passages 674 and 676. Inner case 646 also possesses bypass ports 684 and 686, which are bracketed by seals 662 and 664 when crossover tool 640 is in the open mode, and by seals 664 and 665 when in the closed mode (as illustrated in FIG. 12). Thus, unlike crossover tool 240, the bypass ports in crossover tool 640 are not left open until some positive action is taken to do so, as will be explained hereinafter. When bypass ports 684 and 686 are open, they permit communication between annulus 270 above crossover tool 640 and lower annulus 288 below crossover tool 640. Bypass ports 684 and 686, when open, allow equalization of pressures in the space above and below the crossover tool 640 and, in conjunction with the bypasses of isolation gravel packer and bypass assembly 320, facilitate movement of operating string 30 by allowing fluid movement through and past the operating string 30. At the lower end of case 646 are disposed upward-facing packer cups 690 and 692, which contact production casing 34 above liner hanger 40, and seal the area below them from greater pressure in annulus 270 when reversing circulation or performing any other operation where the annulus 270 is pressurized to a greater extent than annulus 288. Inner bore 672 and crossover annulus 682 exit from the lower end of crossover tool 640, mating with inner blank pipe 298 and concentric outer blank pipe 300, respectively, which extend downward to the remainder of the operating string, which is unchanged.

Figure 15:
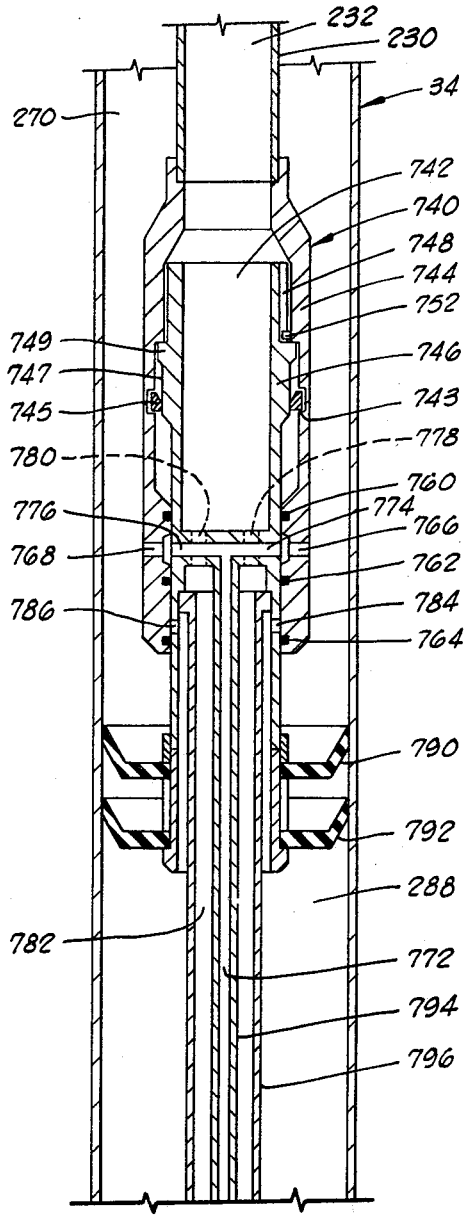
FIG. 15 is a simplified vertical cross-sectional elevation of a second alternative embodiment of the crossover tool of the present invention in the open mode.
Figure 16:
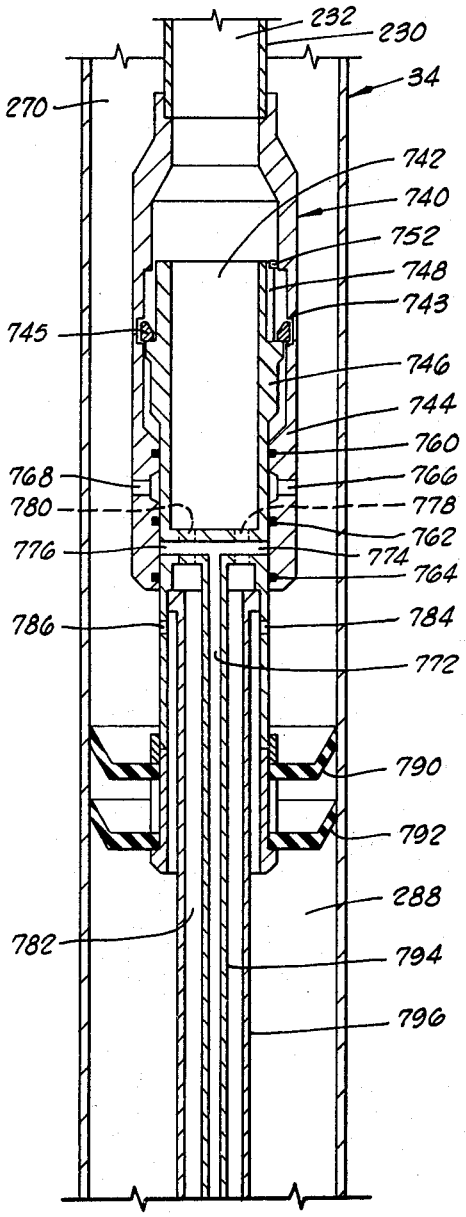
FIG. 16 is a simplified vertical cross-sectional elevation of a second alternative embodiment of the crossover tool of the present invention in the closed mode.

Referring again to FIGS. 11, 12, 13, 14A and 14B, operation of crossover tool 640 is described. As in crossover tool 240, operation is effected by an internal rotating slot mechanism. To ensure that outer sleeve 644 will not rotate with respect to inner casing 646, and thus block circulation passages 674 and 676 even when the tool is in the open mode, pin 652 fixed to outer sleeve 644 slides axially within straight slot 648 of inner case 646. To provide a locking arrangement complex slot 650 in inner case 646 is utilized with pin 654 and ring 656, ring 656 rotationally slidably confined within annulus 658 in outer sleeve 644. Thus, when outer sleeve 644 is reciprocated, pin 654 follows the edges of slot 650 defined by the surface of case 646 and cam island 651. When crossover tool 640 is in the open mode as illustrated in FIG. 11, pin 654 is at position **654*a* as shown in FIG. 14A while pin 652 in straight slot 648 is in axially corresponding position 652*a* as shown in FIG. 14B. When drill pipe 230 and therefore outer sleeve 644 are reciprocated upward, pin 654 moves to position 654*b* being directed thereto first by angled edge 651*a* of cam island 650, and then by angled edge 646*a* of case 646. Crossover tool 640 is now in the closed, bypass closed mode shown in FIG. 12. When drill pipe 230 is set down, pin 654 is directed into position 654*c* in slot recess 650*a* rather than back to 654*a* by angled cam island edge 651*b*. Crossover tool 640 is thus locked in the mode shown in FIG. 12. Pin 652 has also followed the axial portion of the movement of pin 654, as shown at 652*b* and 652*c*. At positions 654*b* and 654*c*, and points therebetween, crossover tool 640 is in the closed mode, and bypass ports 684 and 686, bracketed by seals 662 and 664 in the open mode are opened briefly as seal 665 passes above them during movement at position 654*b*, then closed as the drill pipe is set down and position 654*c* is reached. When it is desired to open the bypass ports again to permit movement of operating string 30 up or down the well bore, drill pipe 230 is once again raised, pin 654 being directed to position 654*d* by angled edge 646*b*, and the bypass ports 684 and 686 are then opened as seal 665 is above them. The bypass ports are locked open (FIG. 13) at this position as at position 654*b* by a collet snap-ring assembly (which has not been shown for the sake of clarity) similar to that illustrated in the second alternative embodiment of the crossover tool shown in FIGS. 15 and 16 and discussed below. As stated previously with respect to crossover tool 240, the collet would be located on the inner casing and the snap-ring disposed thereabout as shown in FIGS. 15 and 16. When bypass ports 684 and 686 are sought to be closed, weight must be set down on the drill pipe 230, which overcomes the snap-ring lock and returns pin 654 to position 654*a*, and the crossover tool 640 to the open mode illustrated in FIG. 11. Pin 654 is prevented from returning to the position 654*c* by inclined cam island edge 651*c*. As before, pin 652 follows the axial segment of the pin 654 movement, going to the 652*d* position when the bypass ports are open, and then back to 652*a* when the drill pipe 230 is set down. Thus, the operation of crossover tool 640 is seen to be markedly similar to that of crossover tool 240, but gives the added capability of being able to seal off everything in the production casing 34** below the crossover tool.

When crossover tool 640 is in the closed mode (FIG. 12) and operating string 30 is anchored at lower zone 28, the casing inflation packer 130 may be tested by pressuring down the operating string 30 through drill pipe 230, with full open gravel collar 140 open, being careful to stay below the formation treating pressure for the zone 28 involved. If a packer leak is present (due to an underinflated packer or, in an open hole, fluid communication around the packer), fluid will flow up around packer 130, back inside gravel screen 122, and up the screen liner assembly operating string annulus, past the upward-facing cups 690 and 692 of crossover tool 640, up to the surface. Should a leak be indicated, the casing inflation packer may be re-inflated using the same procedure as initially described for inflation. It is necessary to close the full open gravel collar for packer re-inflation, which may be accomplished by reciprocating the operating string 30 upward to retract the anchor positioner 470, lowering it, raising it again to release the anchor positioner, this time above the gravel collar 140, and lowering it, whereby spring arms 496 and 498 of anchor positioner 470 will engage the top of sleeve 222 and pull it down into the closed position. After repressuring the packer 130, full open gravel collar 140 may be reopened, as previously described, and the operating string 30 repositioned to test the packer seal again. It should be understood that this inflation packer testing procedure may also be employed with crossover tool 240, as well as with crossover tool 740 described hereafter.

Should the test be successful, packing may begin as soon as the crossover tool 640 is in the open mode. Packing is effected in the same manner as described previously with crossover tool 240, utilizing the open mode. After packing, crossover tool 640 may then be closed to squeeze the gravel pack, if desired, and then re-opened to reverse circulate.

In the event that one wishes to eliminate the mode wherein circulation and bypass ports are both closed, to simplify operation of the crossover tool 640, slot 650, in inner casing 646 may be milled below broken line z as shown in FIG. 13A to place bypass ports 684 and 686 in the open position immediately upon closing the circulation passages 274 and 276. Operation of crossover tool 640, as modified, would be the same as that of 240.

In lieu of utilizing any complex slot whatsoever, a second alternative crossover tool may also be employed, which embodiment involves the employment of a single straight slot to prevent rotation of the outer sleeve, and a collet snap-ring locking mechanism to lock the bypass ports in an open position. This embodiment is illustrated in FIGS. 15 and 16. Crossover tool 740 comprises an outer sleeve 744 surrounding an inner case 746. It is connected to drill pipe 230 in the same manner as the other embodiments previously discussed, as well as to the remainder of operating string 30. Outer sleeve 744 is slidably disposed about inner case 746, and the opening and closing of crossover tool 740 is effected by reciprocation of outer sleeve 744 through the movement of pipe 230 on the surface. Inner case 746 has a single straight slot, 748, machined into its outer surface. Slot 748 slidably engages pin 752, which is fixed to outer sleeve 744 and moves axially in slot 748. Inner case 746 also possesses collet 749 on cylindrical surface 747 upon which split snap-ring 745 slides axially. Outer sleeve 744 possesses annular recess 743, in which snap-ring 745 is housed. Annular recess engages snap-ring 745 upon reciprocation, to move it along cylindrical surface 747 and up and over collet 749 in inner case 746. Outer sleeve 744 also possesses annular seals 760, 762 and 764. Seals 762 and 764 bracket circulation ports 766 and 768, which, when the crossover tool 740 is in its open mode (as illustrated in FIG. 14) permits communication between annulus 270 above crossover tool 740, and inner bore 772, via circulation passages 774 and 776 within inner case 746. Inner case 746 possesses vertical passages 778 and 780, depicted by broken lines, which pass from bore 742 to annular bore 782 of crossover tool 740. Vertical passages 778 and 780 do not communicate with circulation passages 774 and 776. Inner case 746 also possesses bypass ports 784 and 786, which are bracketed by seals 762 and 764 when crossover tool 740 is in the open mode, but which are uncovered when crossover tool 740 is in the closed mode, allowing communication between annulus 270 and lower annulus 288, thus equalizing pressures and permitting fluid flow therebetween. At the lower end of casing 746 are disposed upward-facing packer cups 790 and 792, which contact production casing 34 and seal annulus 288 from annulus 270 when reversing circulation or otherwise pressurizing that area. Inner conduit 794 and concentric outer conduit 796 exit from the lower end of crossover tool 740, mating with inner blank pipe 298 and concentric outer blank pipe 300, respectively, which extend down to the remainder of operating string 30, which is unchanged.

Referring again to FIGS. 15 and 16, operation of crossover tool 740 will be described. Unlike crossover tools 240 and 640, operation is effected through the locking mechanism provided by the snap-ring collet combination described above. To ensure non-rotation of outer sleeve 744 with respect to inner case 746, the same type of pin 752 and slot 748 combination as employed in the other disclosed embodiments is again utilized. To provide a means to lock crossover tool 740 in its closed mode, with bypasses open, snap-ring 745 has been provided. When the tool is closed, as illustrated at FIG. 16, snap-ring 745 has been slid up cylindrical surface 747 on inner case 746, and over collet 749. At this point, as snap-ring 745 is constrained within annular recess 743, outer sleeve 744 remains in its upward position, and the crossover tool 740 in its closed mode. When it is desired to open the tool again, an application of weight to the string will cause snap-ring 745 to expand slightly, due to the split therein (not shown), ride back down over collet 749 and permit movement of outer sleeve 744 downward as it slides down cylindrical surface 747. Downward movement of snap-ring 745 over collet 749 may be facilitated by slightly beveling the edge between its inner and lower surfaces. Thus, picking up on drill pipe 230 will close crossover tool 740, and automatically lock it in its closed mode until weight is applied to the operating string 30. As stated previously, the snap-ring locking mechanism may be incorporated in crossover tools 240 and 640 so that when outer sleeves are picked up for the second time in a cycle of operation, the bypass ports may be locked open. Referring to crossover tool 740 again, the determination of whether or not it is in the open or closed mode may be effected in the same manner as that described for tool 240; however, as setting down weight will automatically open the tool, testing would only be necessary to ascertain if the tool is desired to be closed and the operator was uncertain whether he had applied sufficient upward force. With respect to the gravel packing operation itself, it may be effected as described previously for crossover tool 240, as none of the other tools have been changed, and the circulation passage patterns in the two tools are identical. If it is desired to maintain a crossover tool such as 740 permanently open, if a closed mode is not desired, any of the disclosed crossover tools could be modified by increasing the axial distance between the circulation passages and the bypass ports and axially elongating the circulation ports so that reciprocation of the outer sleeve will not result in circulation passages being covered. With this tool, if a squeeze is desired, circulation up the drill pipe casing annulus may be cut off at the surface to permit pressurization.

It should be noted at this point that a crossover tool per se is not absolutely necessary for the performance of the disclosed method. Concentric blank pipes 298 and 300 may be run from the surface to isolation gravel packer and bypass assembly 320, utilizing surface equipment in lieu of a crossover.

In the event that the operator wishes to employ an operational method using rotational as well as reciprocating motion, an alternative embodiment of the anchor positioner of the present invention may be utilized.

Figure 17:
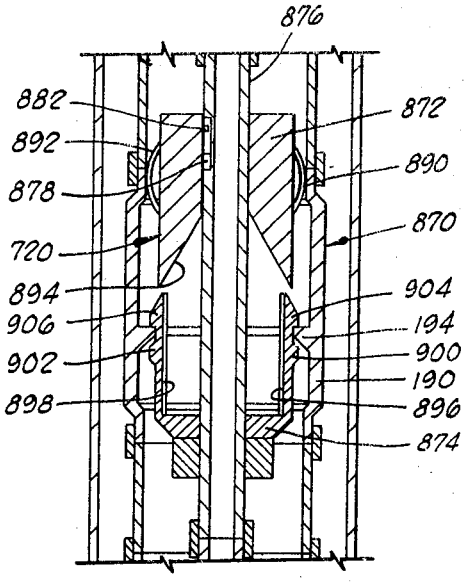
FIG. 17 is a simplified vertical cross-sectional elevation of an alternative embodiment of the anchor positioner of the present invention in the release mode.
Figure 19:
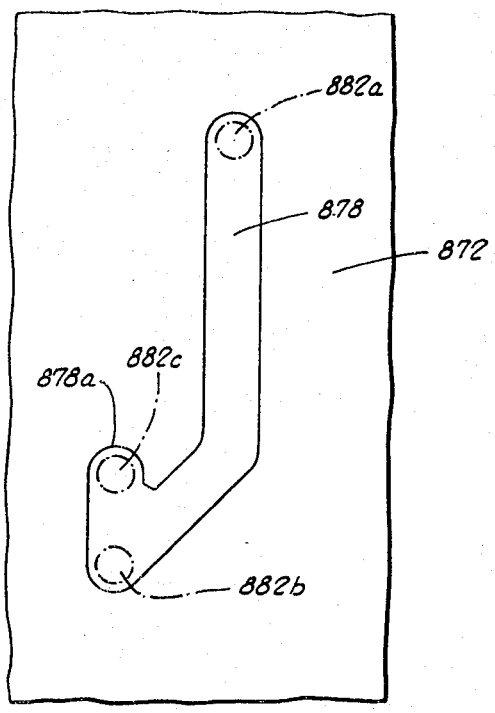
FIG. 19 is a development of the J-slot of the alternative embodiment of the crossover tool of the present invention.
Figure 18:
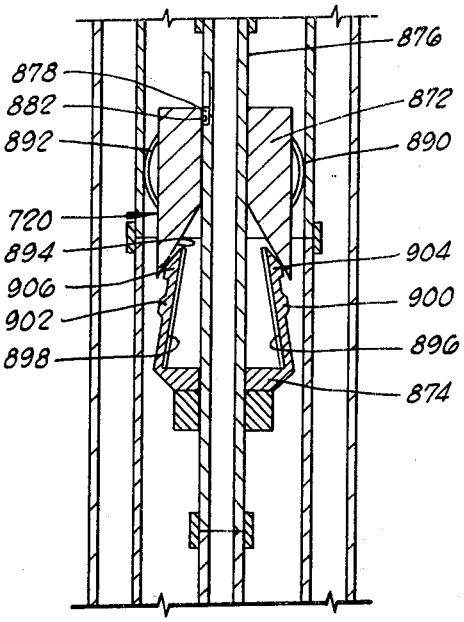
FIG. 18 is a simplified vertical cross-sectional elevation of an alternative embodiment of the anchor positioner of the present invention in the retract mode.

Referring now to FIGS. 17, 18 and 19, an alternative embodiment of the anchor positioner of the present invention is illustrated, designated generally by the reference character 870. Anchor positioner 870 comprises a mandrel 876, drag block assembly 872 slidably mounted thereon, and spring arm body 874 mounted below drag block assembly 872. Drag block assembly 872 has mounted thereon drag blocks 890 and 892, and possesses inclined (frusto-conical) lower face 894. Spring arms 896 and 898 mounted on spring arm body 874 possess at their upper ends protrusions 904 and 906, below which are shoulders 900 and 902. Mandrel 876 has machined therein a J-slot 878, with which pin 882, fixedly mounted on drag block assembly 872, cooperates. When anchor positioner 870 is in the release mode, as shown in FIG. 16 anchored in anchor tool 190, pin 882 is at the top of J-slot 878. This is depicted in FIG. 19, a development of J-slot 878, at position 882*a*. When the operator desires to change the anchor positioner 870 to its retract mode, the drill pipe is reciprocated at the surface, which causes drag block assembly 872 to move downward relative to mandrel 876, retracting spring arms 896 and 898 by their encounter with inclined face 894 in the same manner as previously described with respect to anchor positioner 470. The upward movement of the operating string 30 moves pin 882 into position 882*b*, due to the inclined lower edge of the J-slot, and, when the string is set down again, pin 882 moves to position 882*c*, in which it is locked in slot recess 878*a* until the string is reciprocated upward and turned 30° to the right as it is set down.

Protrusions 904 and 906 have thereon downward facing radially extending shoulders, which engage annular shoulder 194 of anchor tool 190 when anchor positioner 870 passes therethrough and the spring arms 896 and 898 are in the release mode. As described with respect to anchor positioner 470, anchor positioner 870 may be utilized for closing a full open gravel collar, by providing engaging the top of the gravel collar sleeve with spring arms 896 and 898 and moving the operating string downward.

Although the invention has been described in terms of certain embodiments which are set forth in detail, it should be understood that descriptions herein are by way of illustration and not by way of limitation of the invention; as alternative embodiments of the apparatus and operating techniques of the method will be readily apparent to those of ordinary skill in the art in view of the disclosure. For example, the anchor positioner of the present invention might be placed above the isolation gravel packer and bypass assembly and the anchor tool positioned above the gravel collar. Similarly, the check valve could be located at the bottom of the tail pipe. The opening sleeve positioner might be disposed above the isolation gravel packer. Accordingly, modifications such as these and others are contemplated without departing from the spirit and scope of the claimed invention.

We claim:

1. Apparatus for circulating fluid to at least one formation in a well bore, comprising:
   - seal means to isolate said at least one formation from said well bore above said formation;
   - fluid passage means adapted to carry said fluid between a location substantially removed from and above said at least one formation and said at least one formation in isolation from said well bore;
   - circulation means in fluid communication with said fluid passage means and adapted to circulate said fluid from said fluid passage means in one direction to said at least one formation and back to said fluid passage means, and to receive said fluid in the reverse direction from said fluid passage means and return it thereto without moving fluid in contact with said at least one formation; and
   - positioner means to position said circulation means adjacent said at least one formation.

2. The apparatus of claim 1 wherein said at least one formation comprises a plurality of formations.

3. Apparatus for circulating fluid to a plurality of zones having a well bore therethrough, comprising:
   - seal means adapted to isolate each of said plurality of zones;
   - circulation means adapted to selectively circulate fluid in one direction between a location substantially removed from and above the uppermost of said zones and each of said plurality of zones and to circulate fluid between said location and substantially the lower extent of said circulation means during a reversal in the direction of said circulation, said circulation means being further adapted to maintain fluid movement in either direction between said location and substantially the lowest extent of said circulation means separate from said well bore.

4. Apparatus for circulating fluid to a plurality of zones having a well bore therethrough, comprising:
   - seal means adapted to isolate each of said plurality of zones from the well bore thereabove;
   - circulation means adapted to selectively circulate said fluid in one direction between a location substantially removed from and above the uppermost of said zones and each of said plurality of zones and to circulate said fluid between said location and a level in the well bore adjacent to said one of said plurality of zones during a reversal in the direction of said circulation, said circulation means being further adapted to maintain said fluid in isolation from said well bore between said location and said level of said zone to which said fluid is directed.

5. The apparatus of claim 4, and further comprising positioning means adapted to selectively position said circulation means at any of said plurality of zones.

6. Apparatus for circulating fluid to at least one zone penetrated by a well bore, comprising:
   - isolation means adapted to isolate said at least one zone from said well bore thereabove;
   - circulation means adapted to circulate fluid in one direction from a location substantially remote from and above said at least one isolated zone to said at least one isolated zone and back to said location and to reverse circulate fluid from said location to a level proximate said at least one isolated zone, to prevent said reverse circulating fluid from inducing fluid movement at said at least one isolated zone while said reverse circulating fluid is in said

UNITED STATES PATENT AND TRADEMARK OFFICE

CERTIFICATE OF CORRECTION

PATENT NO. : 4,273,190

DATED : June 16, 1981

INVENTOR(S) : E. E. Baker et al.

It is certified that error appears in the above-identified patent and that said Letters Patent are hereby corrected as shown below:

In column 5, line 61, delete the word [inner] and substitute therefor --liner--.

In column 9, line 1, delete the number [240] and substitute therefor --40--.

In column 9, line 42, delete the word [annulus] and substitute therefor --annular--.

In column 16, line 64, delete the number [228] and substitute therefor --328--.

Signed and Sealed this

*Fifteenth* Day of *December 1981*

[SEAL]

*Attest:*

GERALD J. MOSSINGHOFF

*Attesting Officer* *Commissioner of Patents and Trademarks*

(l) moving said operating string to each higher zone and repeating steps (c) through (i) until all zones have been gravel packed.

35. The method of claim 34 including squeezing said gravel packs by pressuring down said first tubing means and preventing fluid circulation up said second tubing means after step (h) and before step (i).

36. A method of gravel-packing a plurality of zones penetrated by a well bore, comprising:

(a) disposing a conduit in said well bore, said conduit having a gravel collar and a screen therebelow at each of said zones, an inflatable packer above each of said zones and an anchor at each of said zones;

(b) movably disposing an operating string in said conduit means, said operating string having an isolation gravel packer, an anchor positioner and a gravel collar opener and closer depending from first and second tubing means;

(c) engaging the uppermost of said anchors with said anchor positioner, thereby juxtaposing said isolation gravel packer and the uppermost of said packers;

(d) inflating said uppermost packer through said first tubing means and said isolation gravel packer;

(e) disengaging said anchor positioner;

(f) moving said operating string down the well bore and repeating each of steps (c) through (e) until all packers have been inflated;

(g) opening said lowermost gravel collar with said opener;

(h) engaging said lowermost anchor with said anchor positioner;

(i) circulating gravel slurry down said first tubing means through said isolation gravel packer and said open gravel collar to the exterior of said conduit and depositing gravel from said slurry in the form of a pack on the exterior of said lowermost screen while returning gravel-free fluid to said second tubing means through said isolation gravel packer;

(j) reversing circulation down said second tubing means through said isolation gravel packer and up said first tubing means;

(k) disengaging said lowermost anchor from said anchor positioner;

(l) closing said gravel collar with said closer;

(m) moving said operating string to each higher zone and repeating steps (h) through (j) until all zones have been gravel packed.

37. The method of claim 36 including squeezing said gravel packs by pressuring down said first tubing means and preventing fluid circulation up said second tubing means after step (i) and before step (j).

* * * * *

UNITED STATES PATENT AND TRADEMARK OFFICE

CERTIFICATE OF CORRECTION

PATENT NO. : 4,273,190

DATED : June 16, 1981

INVENTOR(S) : E. E. Baker et al.

It is certified that error appears in the above-identified patent and that said Letters Patent are hereby corrected as shown below:

In column 5, line 61, delete the word [inner] and substitute therefor --liner--.

In column 9, line 1, delete the number [240] and substitute therefor --40--.

In column 9, line 42, delete the word [annulus] and substitute therefor --annular--.

In column 16, line 64, delete the number [228] and substitute therefor --328--.

Signed and Sealed this

*Fifteenth* Day of *December 1981*

[SEAL]

*Attest:*

GERALD J. MOSSINGHOFF

*Attesting Officer*

*Commissioner of Patents and Trademarks*